US007843478B2

(12) United States Patent
Matsui

(10) Patent No.: US 7,843,478 B2
(45) Date of Patent: Nov. 30, 2010

(54) RECORDING MEDIUM DRIVE APPARATUS, RECORDING MEDIUM, AND DRIVING METHOD FOR RECORDING MEDIUM DRIVE APPARATUS

(75) Inventor: Takeshi Matsui, Tokyo (JP)

(73) Assignee: Sony Corporation, Tokyo (JP)

( * ) Notice: Subject to any disclaimer, the term of this patent is extended or adjusted under 35 U.S.C. 154(b) by 190 days.

(21) Appl. No.: 12/009,274

(22) Filed: Jan. 17, 2008

(65) Prior Publication Data

US 2008/0174655 A1 Jul. 24, 2008

(30) Foreign Application Priority Data

Jan. 19, 2007 (JP) ..... 2007-010121

(51) Int. Cl.
*B41J 2/435* (2006.01)

(52) U.S. Cl. ..... 347/224

(58) Field of Classification Search ..... 347/224, 347/225

See application file for complete search history.

(56) References Cited

U.S. PATENT DOCUMENTS 5,880,453 A * 3/1999 Wang et al. ..... 235/462.01
7,088,380 B2 * 8/2006 Bronson ..... 347/224
7,446,792 B2 * 11/2008 Yamada et al. ..... 347/224
2005/0206661 A1 * 9/2005 Lugaresi et al. ..... 346/131
2006/0262673 A1 * 11/2006 Hanks ..... 369/44.11

FOREIGN PATENT DOCUMENTS

JP 09-131947 A 5/1997
JP 2002-292939 A 10/2002
JP 2004-192735 A 7/2004
JP 2006-331517 A 12/2006
JP 2006-338760 A 12/2006
JP 2006-351052 A 12/2006

* cited by examiner

*Primary Examiner*—Hai C Pham
(74) *Attorney, Agent, or Firm*—Wolf, Greenfield & Sacks, P.C.

(57) ABSTRACT

A recording medium drive apparatus is disclosed. The recording medium drive apparatus includes a holding mechanism, a data recording means, and a printing means. The holding mechanism holds a recording medium having a print target surface targeted for printing and an optical recording surface for data. The data recording means is capable of recording the data on the optical recording surface held by the holding mechanism. The printing means is capable of performing printing on the print target surface of the recording medium and applying a correction fluid on the print target surface.

10 Claims, 23 Drawing Sheets

RECORDING MEDIUM DRIVE APPARATUS, RECORDING MEDIUM, AND DRIVING METHOD FOR RECORDING MEDIUM DRIVE APPARATUS

CROSS REFERENCES TO RELATED APPLICATIONS

The present invention contains subject matter related to Japanese Patent Application JP 2007-010121 filed in the Japanese Patent Office on Jan. 19, 2007, the entire contents of which being incorporated herein by reference.

BACKGROUND OF THE INVENTION

1. Field of the Invention

The present invention relates to a recording medium drive apparatus capable of printing on a disk-shaped recording medium, a recording medium, and a driving method for the recording medium drive apparatus.

2. Description of the Related Art

In the past, there have been optical disk apparatuses capable of recording data on an optical disk having a large storage capacity such as a DVD (Digital Versatile Disc) or BD (Blu-ray Disc (registered trademark)). Among these optical disk apparatuses, for example, there is an apparatus capable of printing characters, a picture, or the like on a label surface of the optical disk (see Patent Documents 1 and 2, for example).

In an optical disk apparatus of Patent Document 1, by counting index signals from a spindle motor which rotationally drives an optical disk, printing on the optical disk is performed in synchronization with the rotation of the optical disk.

Further, in the optical disk apparatus of Patent Document 1, to find a relative position of a print head with respect to the optical disk (coordinates of a rotation angle θ), an address of a data recording surface which is a rear surface of the optical disk is used. This prevents positional displacement, for example, in an addition to or rewriting of print contents.

On the other hand, also in an apparatus of Patent Document 2, ink is jetted from a label printing head in synchronization with the rotation of an optical disk. Information necessary for this synchronization is position information which becomes an original point of the rotation of the optical disk, and to determine the original point, address information recorded on a data recording surface of the optical disk is used.

(Patent Document 1)

Japanese Patent Application Laid-Open No. Hei 9-265760 (paragraphs [0025], [0029], FIG. 1)

(Patent Document 2)

Japanese Patent Application Laid-Open No. 2001-291235 (paragraph [0006], FIG. 1)

SUMMARY OF THE INVENTION

In the apparatuses of Patent Documents 1 and 2, when, for example, an addition to or rewriting of print contents is performed, a user, for example, needs to erase an original print image on a print target surface of the optical disk by some means, which takes time and effort. For example, it is conceivable that in order to erase the print image, the user puts a sticker or the like on the optical disk over the original print image. However, it also takes time and effort, and the sticker may cause deviation of a barycentric position of the optical disk from the position of the rotation center, whereby the optical disk is decentered. As a result, the stable signal recording or reproduction may become impossible. In particular, the higher the recording density of the optical disk, the more marked this problem becomes.

On the other hand, it is sometimes troublesome for the user to decide, for example, at which position of the optical disk printing is to be performed or with what design printing is to be performed.

In view of the above circumstances, it is desirable to provide a technique of a recording medium drive apparatus or the like capable of easily correcting print contents.

It is further desirable to reduce troublesome work regarding printing such as making a decision on print layout.

According to an embodiment of the present invention, there is provided a recording medium drive apparatus including a holding mechanism, a data recording means, and a printing means. The holding mechanism holds a recording medium having a print target surface targeted for printing and an optical recording surface for data. The data recording means is capable of recording the data on the optical recording surface held by the holding mechanism. The printing means is capable of performing printing on the print target surface of the recording medium and applying a correction fluid on the print target surface.

In the embodiment of the present invention, by applying the correction fluid on the print target surface by the printing means, it becomes possible to correct a print image. This mostly eliminates decentering of the recording medium compared to when the print image is corrected by putting a sticker or the like over the print image, whereby recording or reproduction of data is prevented from becoming unstable. Accordingly, erasing of, additional recording to, and rewriting of print contents can easily be performed.

The "additional recording" means recording of different data (additional data described later) on a second recording region different from a first recording region on which data is already recorded out of recording regions of the recording medium.

The "rewriting" means overlapping recording of different data (second data described later) on all or part of a first region on which data is already recorded or a region larger than the first region out of the recording regions of the recording medium.

According to the embodiment of the present invention, the recording medium drive apparatus further includes a storing means. The storing means stores print information being information on a print image to be printed on the print target surface and data identification information identifying the data in association with each other. This facilitates management of the recording medium. For example, when data is additionally recorded, a print image of print information corresponding to the additionally recorded data can be prevented from being erroneously printed on another already existing print image.

According to the embodiment of the present invention, when additional data is additionally recorded on the recording medium by the data recording means, the storing means stores additional data identification information identifying the additional data and additional print information corresponding to the additional data out of the print information in association with each other, and the printing means prints a print image corresponding to the stored additional print information on the print target surface.

According to the embodiment of the present invention, when first data being data before rewriting recorded on the recording medium out of the data is rewritten into second data being data after rewriting by the data recording means, the storing means stores second data identification information identifying the second data and rewriting print information corresponding to the second data out of the print information in association with each other, and the printing means applies the correction fluid on a first print image corresponding to the first data and prints a second print image corresponding to the stored rewriting print information on the print target surface. A determining means for determining whether or not the original print information and the rewriting print information are the same may be provided. In this case, when the print information and the rewriting print information are different, the printing means has only to print the second print image.

According to the embodiment of the present invention, when erasing target data recorded on the recording medium out of the data is erased by the data recording means, the storing means erases erasing target print information corresponding to the erasing target data out of the print information, and the printing means applies the correction fluid on an erasing target print image corresponding to the erasing target print information.

According to the embodiment of the present invention, the recording medium drive apparatus further includes a recording control means. The recording control means controls the data recording means so that print information being information on a print image to be printed on the print target surface and identification information identifying the data are recorded on the optical recording surface in association with each other. In the embodiment of the present invention, the print information is recorded on the optical recording surface in association with the data, so, for example, when data is additionally recorded, management of the recording medium is facilitated. For example, as in the following embodiment of the present invention, when data is additionally recorded on the recording medium, print contents can be easily changed.

According to the embodiment of the present invention, when additional data is additionally recorded on the recording medium by the data recording means, the recording control means records additional data identification information identifying the additional data and additional print information corresponding to the additional data out of the print information in association with each other, and the printing means prints a print image corresponding to the recorded additional print information on the print target surface.

According to the embodiment of the present invention, when first data being data before rewriting recorded on the recording medium out of the data is rewritten into second data being data after rewriting by the data recording means, the recording control means records second data identification information identifying the second data and rewriting print information corresponding to the second data out of the print information in association with each other, and the printing means applies the correction fluid on a first print image corresponding to the first data and prints a second print image corresponding to the recorded rewriting print information on the print target surface. A determining means for determining whether or not the original print information and the rewriting print information are the same may be provided. In this case, when the print information and the writing print information are different, the printing means has only to print the second print image.

According to the embodiment of the present invention, when erasing target data recorded on the recording medium out of the data is erased by the data recording means, the recording control means erases erasing target print information corresponding to the erasing target data out of the print information, and the printing means applies the correction fluid on an erasing target print image corresponding to the erasing target print information.

According to the embodiment of the present invention, the recording medium has a print target region which is a region provided on the print target surface and targeted for the printing, and the recording medium drive apparatus further includes a position information storing means. The position information storing means stores position information indicating a position of the print target region on the print target surface. In the embodiment of the present invention, the print target region is previously provided on a first surface of the recording medium. Consequently, the user can reduce troublesome work regarding printing such as making a decision on print layout.

According to the embodiment of the present invention, the recording medium has a mark provided on the print target surface, and the recording medium drive apparatus further includes a sensor and a detecting means. The sensor detects the mark. The detecting means detects the print target region using the mark detected by the sensor and address information indicating a position on the optical recording surface recorded on the optical recording surface. Hence, the recording medium drive apparatus can detect the print target region and accurately perform printing on the print target region.

According to the embodiment of the present invention, the recording medium has a mark recorded on the optical recording surface, and the recording medium drive apparatus further includes a data reproducing means and a detecting means. The data reproducing means detects the mark. The detecting means detects the print target region using the mark detected by the data reproducing means and address information indicating a position on the optical recording surface recorded on the optical recording surface. In other words, the data reproducing means for detecting the mark is a function included in an optical pickup, and hence another sensor to detect the mark becomes unnecessary. Accordingly, a reduction in cost can be achieved.

A recording medium according to an embodiment of the present invention includes a first surface and a second surface. On the first surface, data is optically recordable. The second surface has a print target region targeted for printing and has an image printed so as to surround the print target region. Consequently, the user can reduce troublesome work regarding printing such as making a decision on print layout.

A driving method of a recording medium drive apparatus according to an embodiment of the present invention includes holding a recording medium having a print target surface targeted for printing and an optical recording surface for data, and applying a correction fluid on a print image printed on the print target surface of the held recording medium. In the embodiment of the present invention, by applying the correction fluid on the print target surface, the print image can be corrected. Consequently, erasing of, additional recording to, and rewriting of print contents can easily be performed.

As described above, according to the embodiments of the present invention, it is possible to easily correct print contents. Alternatively, troublesome work regarding printing such as making a decision on print layout can be reduced.

DESCRIPTION OF PREFERRED EMBODIMENTS

Embodiments of the present invention will be described below with reference to the drawings.

Figure 1:
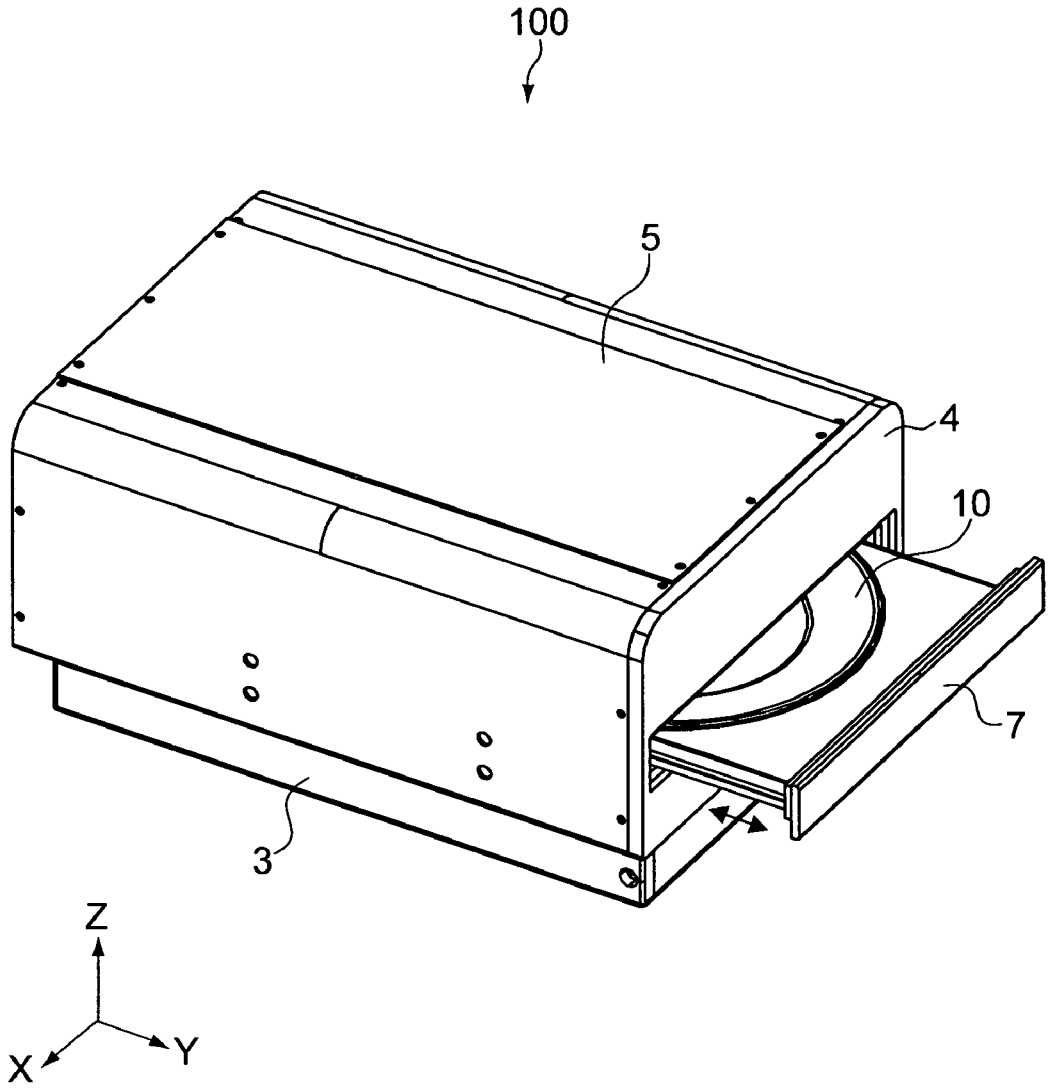
FIG. 1 is a perspective view showing an optical disk drive apparatus as a recording medium drive apparatus according to an embodiment of the present invention.
Figure 2:
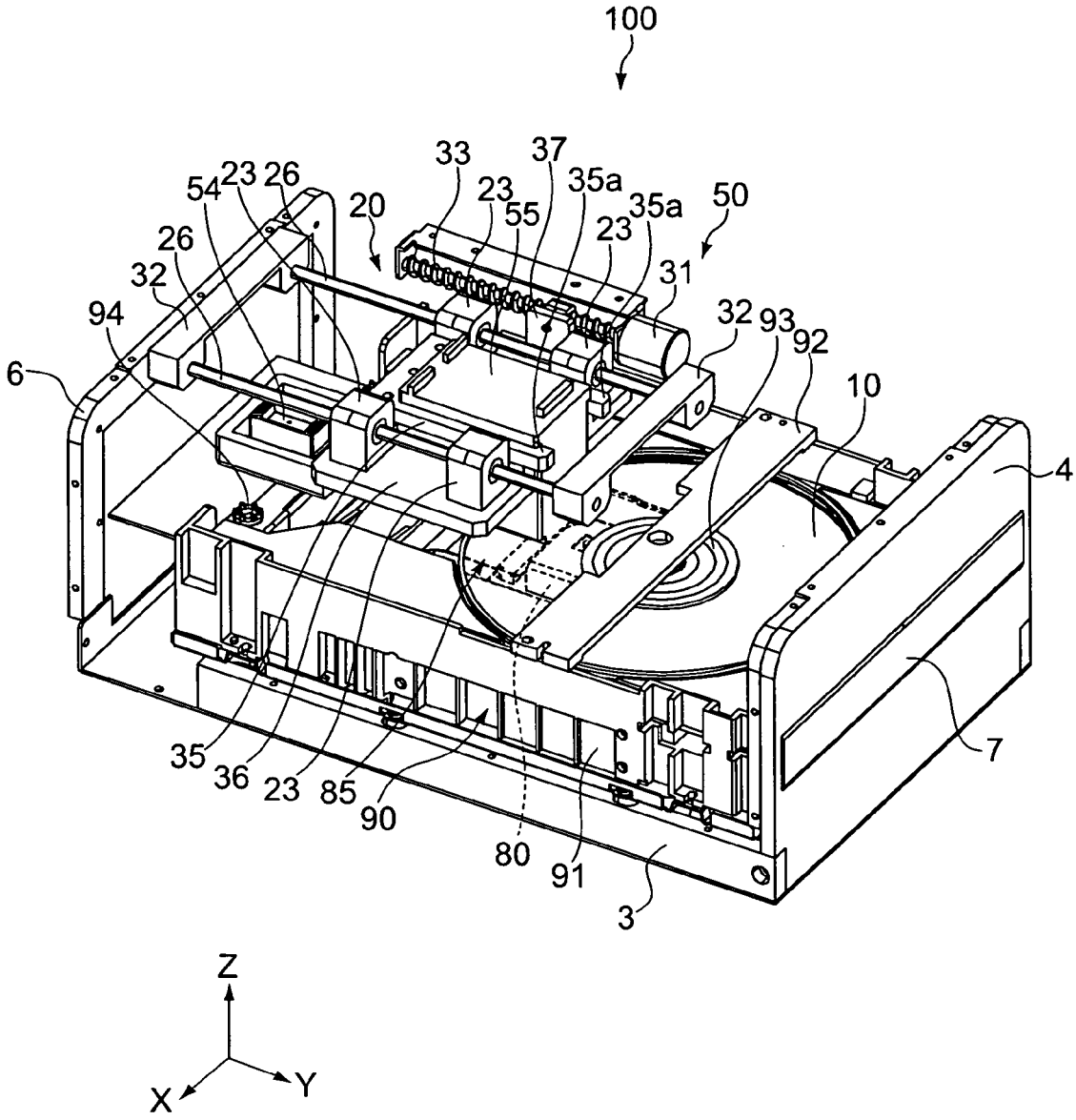
FIG. 2 is a perspective view showing the internal structure of the optical disk drive apparatus shown in FIG. 1.
Figure 3:
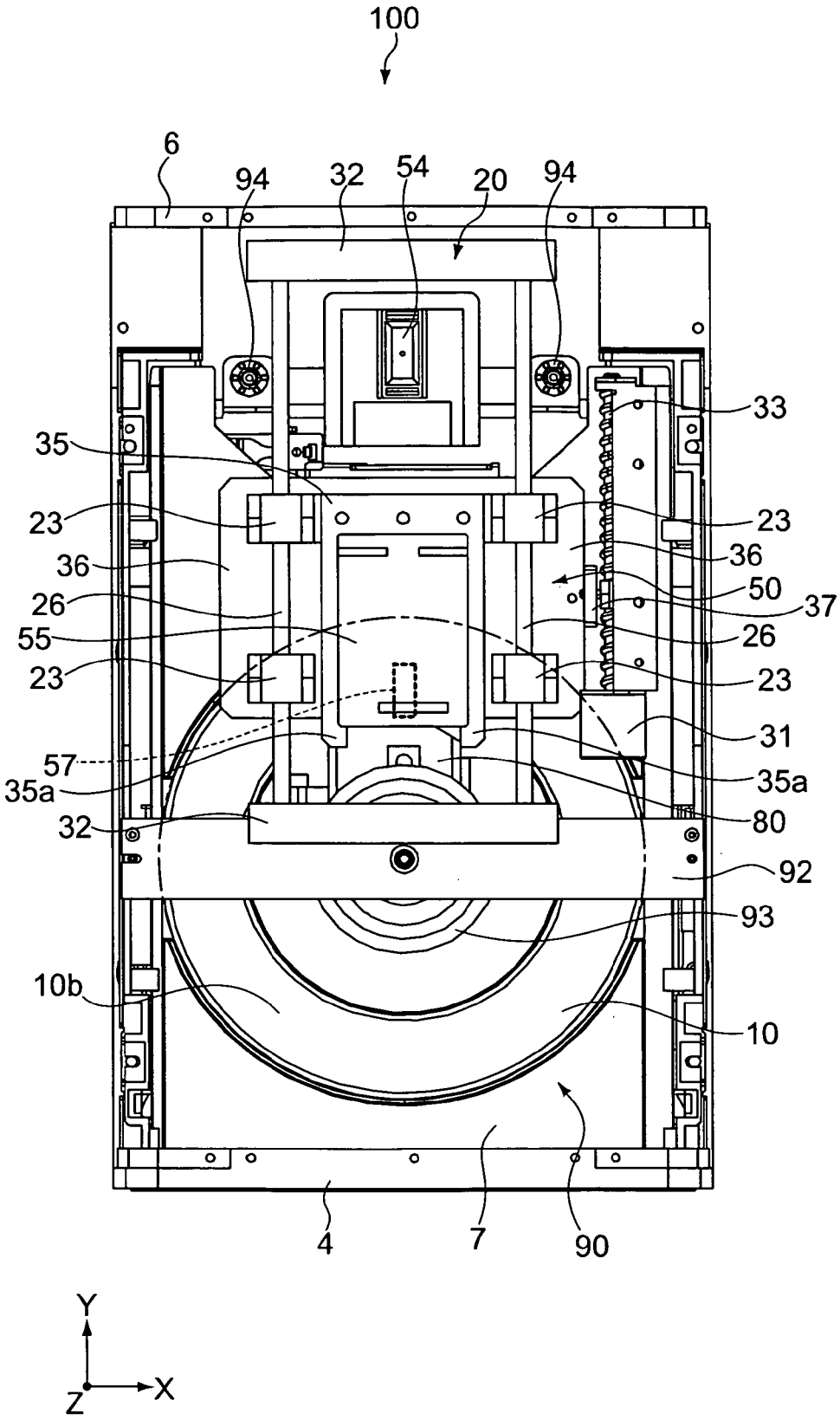
FIG. 3 is a plan view showing the internal structure of the optical disk drive apparatus shown in FIG. 2.

FIG. 1 is a perspective view showing an optical disk drive apparatus as a recording medium drive apparatus according to an embodiment of the present invention. FIG. 2 is a perspective view showing the internal structure of an optical disk drive apparatus 100 shown in FIG. 1. FIG. 3 is a plan view showing the internal structure of the optical disk drive apparatus 100 shown in FIG. 2. Incidentally, in FIG. 2 and FIG. 3, an electric circuit board, wiring, and other mechanisms unrelated to the present invention are not shown.

The optical disk drive apparatus 100 is an apparatus which at least either optically records data on a disk-shaped recording medium (hereinafter referred to only as a disk) 10 or reproduces recorded data.

As an example of the disk 10, a CD (Compact Disc), a DVD (Digital Versatile Disc), a BD (Blu-ray Disc (registered trademark)), an HD (High Definition)-DVD, a disk using near-field light, a disk using a hologram, an MO (Magneto Optical), or an MD (Mini-Disk) is cited. Further, particularly, a bare DVD, a bare BD, a bare disk using near-field light, a bare disk using a hologram, or the like is sometimes housed in a cartridge.

The optical disk drive apparatus 100 includes a base 3, a drive unit 90 mounted on the base 3 and includes a data recording means, and a printing unit 50 placed on top of the drive unit 90.

The drive unit 90 includes a disk tray 7 which carries the disk 10 while the disk 10 is mounted thereon and a loading mechanism not shown which moves the disk tray 7 in a forward/backward direction (Y direction). Further, the drive unit 90 includes an optical pickup 80 having an objective lens, an actuator, and so on and a thread mechanism not shown which moves this optical pickup 80 in a radial direction (Y direction in the figures) of the disk 10. The loading mechanism and the thread mechanism can be variously structured and, for example, may have well-known structures. Furthermore, the drive unit 90 includes a chucking plate 93 which holds the disk 10 particularly when data is recorded/reproduced. The chucking plate 93 is attached to a proper plate material 92 so as to be suspended therefrom. An optical pickup unit 85 including the optical pickup 80 and the thread mechanism is connected to a chassis 91 via a damper 94 for vibration isolation.

The chucking plate 93 constitutes part or all of a holding mechanism of the disk 10. A turn table not shown is provided on top of a spindle motor 82. The holding mechanism of the disk 10 may be constituted by the chucking plate 93 and this turn table.

A front panel 4 is provided on the front side of the optical disk drive apparatus 100, and a back panel 6 is provided on the back side thereof. Further, as shown in FIG. 1, the optical disk drive apparatus 100 includes an external cover 5 which is detachable from the base 3, the front panel 4, the back panel 6, or the like and covers an internal mechanism of the optical disk drive apparatus 100. In the following description, the front panel 4 side is called the front side, and the back panel 6 side is called the back side.

The printing unit 50 includes a print head 55 placed so as to face the disk 10, a holder 35 holding the print head 55, attaching plates 36 connected to the holder 35, and a moving mechanism 20 connected to the attaching plates 36 and moves the print head 55 in a Y direction.

Figure 4A:
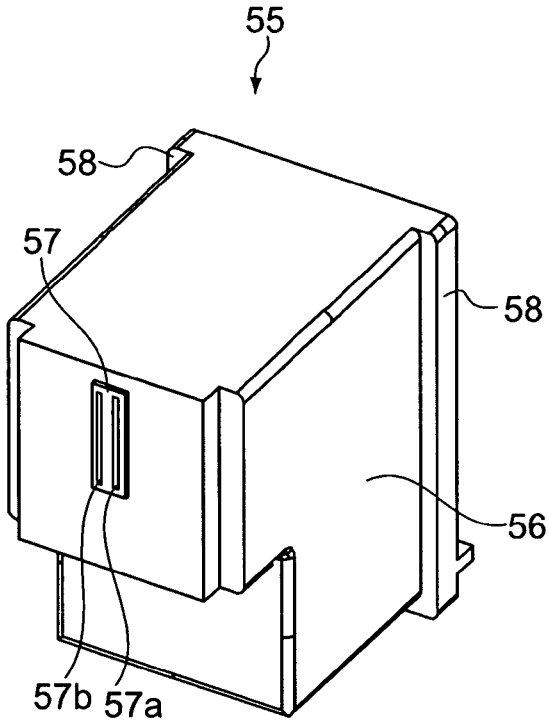
FIG. 4A is a perspective view of a print head viewed from the lower side.
Figure 4B:
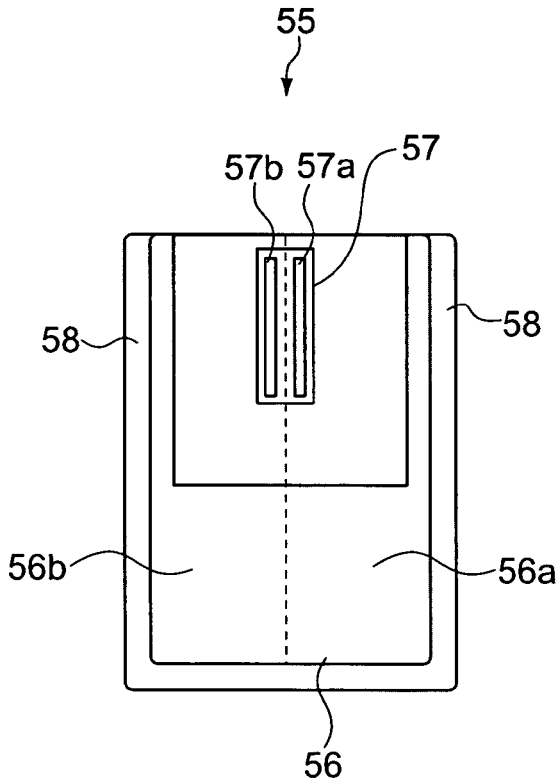
FIG. 4B is a plan view of the print head viewed from the lower side.

FIG. 4A is a perspective view of the print head 55 viewed from the lower side. FIG. 4B is a plan view of the print head 55 viewed from the lower side.

The print head 55 includes an ink tank portion 56 and an ink discharge portion 57. As shown in FIG. 4B, the interior of the ink tank portion 56 is divided into two tank regions 56*a* and 56*b*. The first tank region 56*a* is filled with black ink, and the second tank region 56*b* is filled with white ink. The white ink is used, for example, as a correction fluid. Capacities of the first tank region 56*a* and the second tank region 56*b* may be different. The ink discharge portion 57 includes a first ink discharge portion 57*a* discharging the black ink from the first tank region 56*a* and a second ink discharge portion 57*b* discharging the white ink from the second tank region 56*b*.

The print head 55 is placed so that during printing, the ink discharge portion 57 faces a print target surface 10*b* of the disk 10. The print target surface 10*b* is a surface on the opposite side of an optical recording surface 10*a*.

Typically, an ink-jet print head is used as the print head 55. In this case, the ink discharge portion has a built-in piezoactuator or heater.

Instead of or in addition to the black ink, plural color inks may be used. In this case, the tank region and the ink discharge portion are divided for the respective colors. The color inks, for example, include, but are not limited to, cyan, magenta, and yellow.

Figure 5:
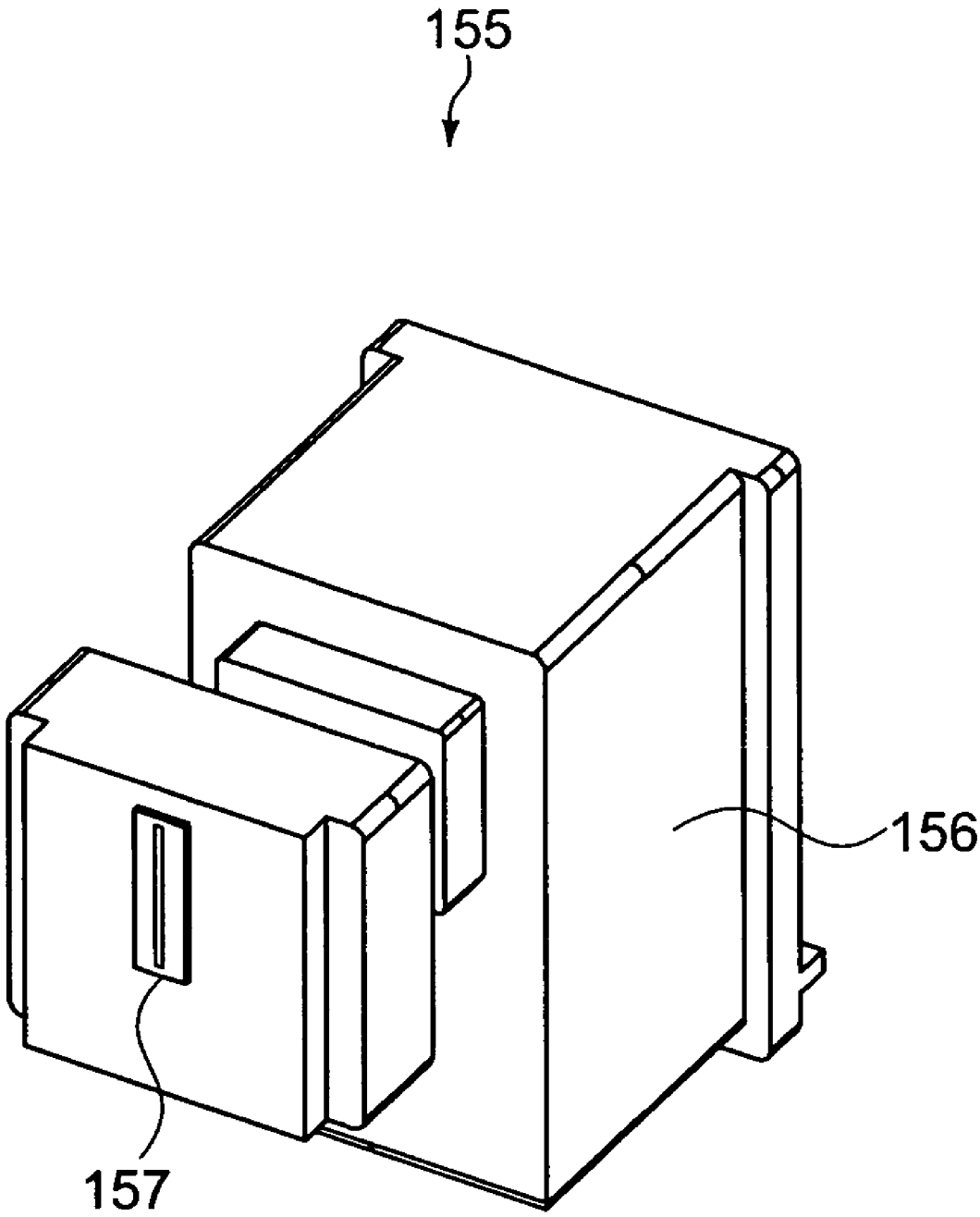
FIG. 5 is a perspective view of a print head according to another embodiment viewed from the lower side.

FIG. 5 is a perspective view of a print head according to another embodiment viewed from the lower side. In a print head 155 according to this embodiment, an ink tank portion 156 and an ink discharge portion 157 are separate and connected by a pipe not shown.

The print target surface 10*b* of the disk 10 has a color close to white in many cases, so the white ink is used as the correction fluid. However, if there exists the disk 10 whose print target surface 10*b* has a color other than white and is assumed to be printed with ink having a color other than white, the ink having the color other than white may be used as the correction fluid.

As shown in FIG. 2, the holder 35 is a U-shaped member having engaging portions 35*a* engaging with flange portions 58 provided at an upper portion of the print head 55. The attaching plates 36 are fixed to the engaging portions 35*a*.

The moving mechanism 20 has bearing blocks 23 attached onto the attaching plates and shafts 26 respectively inserted through linear bearings provided in the bearing blocks 23. The attaching plates 36, the bearing blocks 23, and the shafts 26 are respectively placed on both sides in an X direction of the print head 55. A connecting portion 37 is provided on one attaching plate 36, and the attaching plate 36 is connected to a ball screw 33 which is rotated by a drive motor 31 via this connecting portion 37. Both ends of the shafts 26 are connected to appropriate fixing blocks 32. Driving of the drive motor 31 causes the print head 55 to move between a standby position on the back side and, for example, a position above the print target surface 10*b* of the disk 10 chucked by the chucking plate 93. Incidentally, FIG. 3 shows a state where the print head 55 is at the position above the print target surface 10*b*.

A cap 54 of the ink discharge portion 57 of the print head 55 is placed at the standby position. An ink collector not shown collecting the ink discharged from the print head 55 is placed under the cap 54 (see FIG. 2). The ink collector is provided in order to remove bubbles mixed into the ink by discharging the ink from the print head 55 into the ink collector, for example, before print processing.

Figure 6:
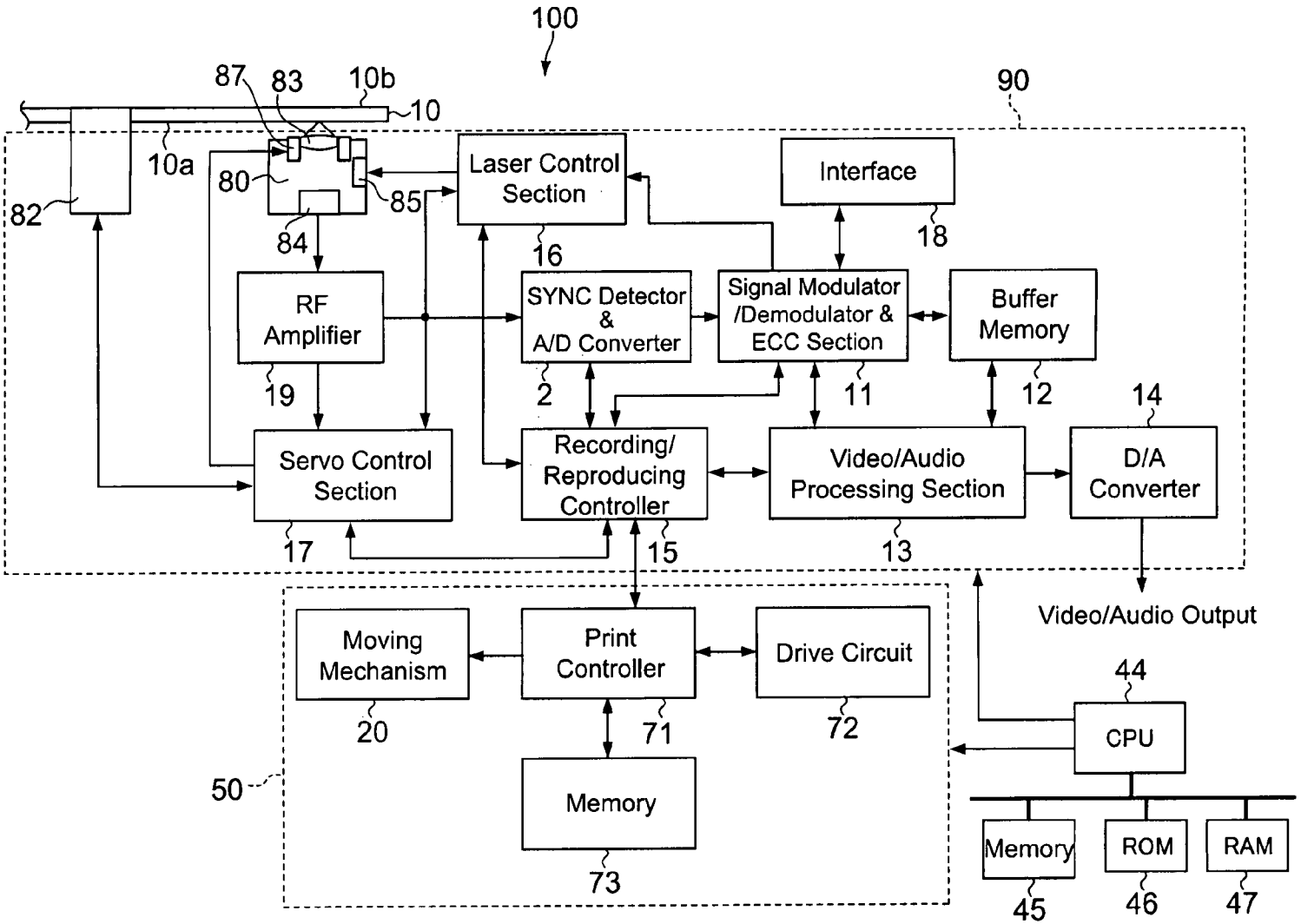
FIG. 6 is a block diagram showing the constitution of this optical disk drive apparatus.

FIG. 6 is a block diagram showing the constitution of the optical disk drive apparatus 100.

The drive unit 90 of the optical disk drive apparatus 100 includes a spindle motor 82, the above optical pickup 80, an RF amplifier 19, a three-axis actuator 87, and a servo control section 17.

The spindle motor 82 functions as a rotation drive mechanism which rotates the disk 10. The optical pickup 80 includes a laser light source 85, an objective lens 83 which collects laser light emitted from the laser light source 85 on the disk 10, a photodetector (PD) 84 which detects reflected return light from the disk 10, and so on. For example, a solid-state laser, particularly a laser diode (LD) is used as the laser light source 85, but the laser light source 85 is not limited to the above. The optical pickup 80 additionally includes an optical system to guide the laser light emitted from the laser light source 85 to the objective lens 83, and so on. The RF amplifier 19 generates a focus error signal, a tracking error signal, an RF signal, and so on based on various signals outputted from the PD 84 of the optical pickup 80. The three-axis actuator 87 moves particularly the objective lens 83 portion of the optical pickup 80 in a tracking direction, a focusing direction, and a tilt direction.

The servo control section 17 outputs various servo signals to the three-axis actuator 87 and the spindle motor 82 based on the focus error signal, the tracking error signal, and the RF signal. The servo control section 17 outputs the servo signals also to the above thread mechanism.

The drive unit 90 includes a recording/reproducing controller 15, a laser control section 16, a synchronous detector & A/D converter 2, a signal modulator/demodulator & ECC (Error Correction Code) section 11, a buffer memory 12, a video/audio processing section 13, a D/A converter 14, and an interface 18.

The recording/reproducing controller 15 receives inputs of and outputs various signals to collectively control the entire drive unit 90. The laser control section 16 receives a modulation signal from the signal modulator/demodulator & ECC section 11 and modulates laser power of the laser light source 85 to write the signal into the disk 10 and controls the laser power based on the RF signal. The synchronous detector & A/D converter 2 further generates clocks based on synchronous signals recorded on the disk 10 at predetermined intervals and converts an analog signal into a digital signal. The signal modulator/demodulator & ECC section 11 performs signal modulation/demodulation, addition of an ECC, and error correction processing based on the ECC. The buffer memory 12 temporarily stores data during the processing in the signal modulator/demodulator & ECC section 11. The video/audio processing section 13 performs necessary video processing and audio processing and outputs video and audio in an analog form via the D/A converter 14. The interface 18 is an interface to connect an external computer, video/audio sources, and so on not shown.

The printing unit 50 includes a print controller 71, the above moving mechanism 20, a drive circuit 72 for the print head 55, and a memory 73 which stores data on print information being information on print contents (hereinafter referred to as print data).

The print controller 71 receives an input of a signal from the recording/reproducing controller 15 and outputs a signal to the recording/reproducing controller 15. Further, the print controller 71 controls the moving mechanism 20 and the drive circuit 72. The drive circuit 72 is a circuit which drives the above piezoactuator or the like of the print head. The memory 73 temporarily stores print data, for example, from a PC, a memory card, or any other external device.

The optical disk drive apparatus 100 includes a CPU 44 which collectively controls the entire optical disk drive apparatus 100 and also includes a ROM 46, a RAM 47, a memory 45 as a storing means, and so on. A program necessary for the operation of the optical disk drive apparatus 100 is stored in the ROM 46. The memory 45 has a function of storing necessary information. The memory 45 is constituted, for example, by a flash memory or any other rewritable memory. The CPU 44 may be constituted, for example, by an FPGA (Fluid Programmable Gate Array), a DSP (Digital Signal Processor), or a combination of these two.

In data recording on the optical recording surface 10*a* of the disk 10, digital data inputted from the external computer not shown to the interface 18 is modulated after an error correction code is added thereto in the signal modulator/demodulator & ECC section 11. Based on the modulated data, a pulse is generated by the laser control section 16 and the laser light is irradiated onto the disk 10 via the optical pickup 80, whereby the data is recorded. During the data recording, servo control is properly performed by the servo control section 17.

On the other hand, in data reproduction from the optical recording surface 10*a* of the disk 10, the laser light is irradiated onto the disk 10 and its return reflected light is detected by the PD 84. The reflected light detected by the PD 84 is amplified, subjected to waveform equalization, and the like in the RF amplifier 19 to reproduce the RF signal, and a bit string obtained by binarizing the RF signal is generated by the synchronous detector & A/D converter 2. The generated bit string is subjected to signal demodulation and error correction by the signal modulator/demodulator & ECC section 11. The demodulated signal is separated by the video/audio processing section 13 into video data and audio data, which are then subjected to D/A conversion and outputted in an analog form. During the data reproduction, servo control is properly performed by the servo control section 17.

Figure 7:
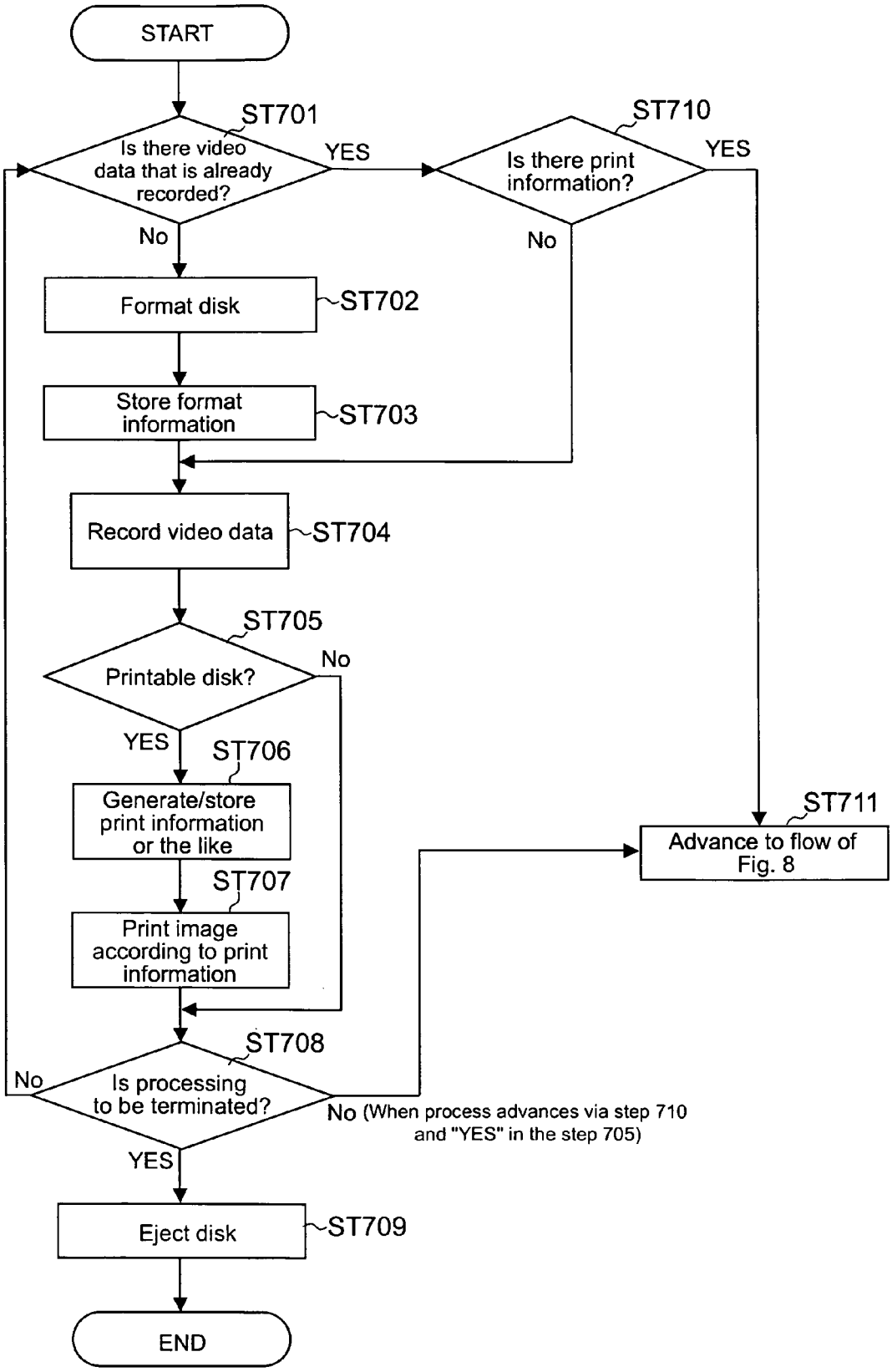
FIG. 7 is a flowchart showing an example of the operation of the optical disk drive apparatus including the operation of a printing unit.
Figure 8:
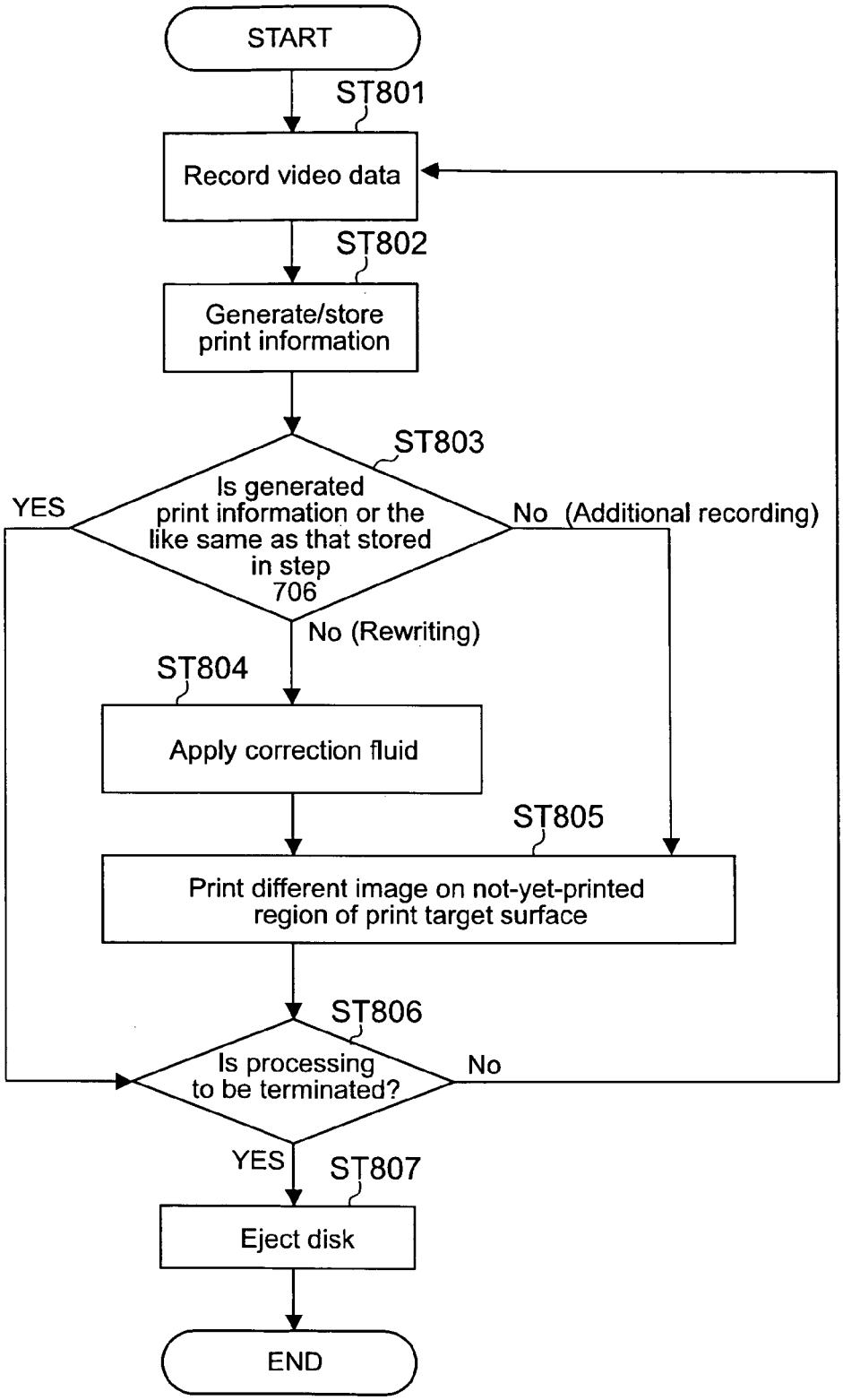
FIG. 8 is a flowchart showing the operation following the operation of FIG. 7.

Next, the operation of the optical disk drive apparatus 100 including the operation of the printing unit will be described. FIG. 7 and FIG. 8 are flowcharts showing an example of this operation.

When the disk 10 is mounted on the disk tray 7 and loaded in the optical disk drive apparatus 100, it is determined whether or not data is already recorded on the optical recording surface 10*a* of the disk 10 by driving of the optical pickup 80 according to control of the recording/reproducing controller 15 (step 701). The term "data" here may be anything, including video data, audio data, and text-based data. In the following description, to make the description easy to understand, video data (still image or moving image data) is cited as an example of the data.

When the video data is not recorded, a recording region of the optical recording surface 10*a* of the disk 10 is formatted in a predetermined form by driving of the optical pickup 80 according to control of the recording/reproducing controller 15 (step 702). The form of the format varies depending on the type of the disk and may be anything. Further, when the recording region is formatted, format information is stored in the buffer memory 12, the RAM 47, or the memory 45 (step 703).

Video data of one title, for example, is recorded on the optical recording surface 10*a* of the disk 10 by driving of the optical pickup 80 according to control of the recording/reproducing controller 15 (step 704). One title means, for example, one movie, a drama of one episode to several episodes which are temporally continuous, or any other temporally continuous program.

According to control of the CPU 44, it is determined whether or not the disk 10 is a disk having a print target surface 10*b* that can be printed (step 705). For example, when the disk 10 has the print target surface 10*b*, the determination of step 705 becomes possible if a signal indicating that the disk 10 has the print target surface 10*b* is recorded on the optical recording surface 10*a*. Alternatively, it is also possible to provide a sensor (not shown) which detects the print target surface 10*b* on the side facing the print target surface 10*b*, that is, on the side where the printing unit 50 is placed and make the determination of step 705 based on a detection signal of the sensor. In this case, the detection can be made according to the reflected light amount by a reflective optical sensor, for example, as the sensor.

When the disk 10 has the print target surface 10*b*, print information corresponding to the recorded video data is generated according to control of the CPU 44 and stored in the memory 45 (step 706). The print information is information on a print image to be printed on the print target surface 10*b*. The print information is text-based data of the date and time when the video data is recorded, a title, and so on. Alternatively, the print information may be a photograph, a picture, or the like prepared by the user or a thinned-out image (so-called thumbnail image) being part of the video data.

In the memory 45, video data identification information indicating the video data and the print information are stored as an associated table. Alternatively, the video data identification information indicating the video data and print information identification information indicating the print information are stored. The video data identification information and the print information identification information are, for example, sequential numbers, alphabets, date and time when recording is performed, or any other identifiable information.

When the print information is generated and stored, the print image corresponding to the print information is printed on the print target surface 10*b* by driving of the drive circuit 72 and driving of the moving mechanism 20 according to control of the print controller 71 (step 707). In step 707, the disk 10 is rotated, for example, by the spindle motor 82 at an rpm of several tens to several hundreds or more, for example, at 900 rpm. The print head 55 is moved from the standby position to a position above the print target surface 10*b* by the moving mechanism 20 and discharges the ink to the disk 10, thereby performing the printing. The print head 55 is properly moved by the moving mechanism 20 when discharging the ink, thereby generating an appropriate print image. Incidentally, when the printing is performed while the disk 10 is being rotated as just described, the print information is subjected to polar coordinate transformation processing and printed.

Further, in this print processing, in order that the optical disk drive apparatus 100 accurately recognizes a print position, address information recorded on the optical recording surface 10*a* of the disk 10 is used. The address information is, for example, a wobble, a pre-pit, their combination, or any other physical address information. The address information is read by the optical pickup 80 and sent to the print controller 71. Based on this address information, the print controller 71 outputs a control signal to drive the moving mechanism 20 and the drive circuit 72.

Figure 9:
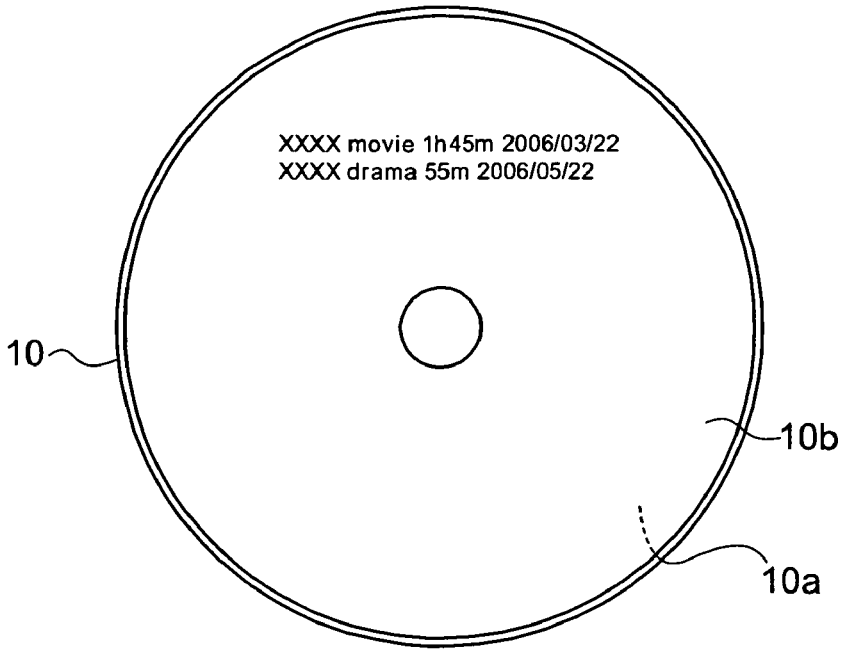
FIG. 9 is a view showing an example of a disk on which characters are printed.

FIG. 9 is a view showing an example of the printed disk 10. In this example, the title, date, and so on of the video data are printed as characters.

After the printing is completed, a selection of whether or not to terminate the recording processing and print processing of the video data is presented to the user (step 708). In this case, according to control of the CPU 44, it is only necessary to make the presentation by the display on a display or the like connected to the external computer or the like via the interface 18 or by sound by a speaker. When termination is selected, the disk 10 is ejected by the drive unit 90 while being mounted on the disk tray 7 (step 709).

Incidentally, when the disk 10 does not have the print target surface 10*b* in step 705, the process advances to step 708.

Next, a case where data is already recorded on the optical recording surface 10*a* of the disk 10 in step 701 will be described. In this case, it is determined whether or not the print information or the above print information identification information (hereinafter called "print information or the like") together with the above video data identification information is stored in the memory 45 according to control of the CPU 44 (step 710). When the print information or the like is not stored in the memory 45, the process advances to step 704, and operations of steps 704 to 708 are performed in the same manner as the above operations.

When the recording processing and print processing of the video data are not terminated in step 708, the process advances to the flow shown in FIG. 8. Also when the print information or the like together with the video data identification information is already stored in the memory 45 in step 710, the process advances to the flow shown in FIG. 8.

As shown in FIG. 8, video data is further recorded on the optical recording surface 10*a* by driving of the optical pickup 80 according to control of the recording/reproducing controller 15 (step 801). In most cases, the operation of step 801 is the operation of additional recording of or rewriting into the video data as to be described later. When the video data is recorded, print information or the like corresponding to the video data is generated and recorded in the memory 45 according to control of the CPU 44 (step 802). According to control of the CPU 44, it is determined whether or not the recorded print information or the like and the print information or the like already stored in step 706 are the same (step 803).

When both are the same print information or the like, the recording processing and print processing of the video data are terminated (step 806), and the disk 10 is ejected (step 807). Whether or not they are the same print information or the like depends on by what the print information or the like is defined. For example, when the print information or the like is defined by the title of the video data, both are the same, but when it is defined by the recording date and time of the video data, both are not the same. Typically, the print information or the like is defined by the date and time, the date and time including the title, or the like. When both are not the same print information or the like (NO in step 803), the operation of step 801 becomes the operation of additional recording of or rewriting into the video data.

Figure 10:
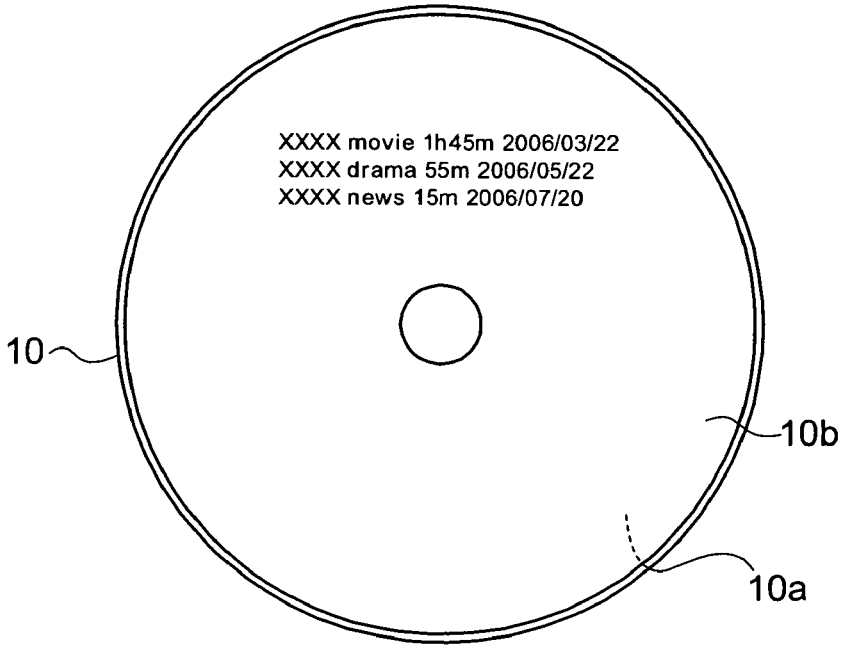
FIG. 10 is a view showing an example of the disk on which a print image is added.

When the video data (additional data) is additionally recorded in step 801, a different image (print image) is printed on a not-yet-printed region of the print target surface 10*b* based on the address information recorded on the optical recording surface 10*a* according to controls of the CPU 44 and the print controller 71 (step 805). This different print image is a print image corresponding to the print information (additional print information) generated and stored in step 802. For example, as shown in FIG. 10, "XXXX news 15 m 2006/07/20" corresponding to the third video data recorded in step 801 is additionally printed on the print target surface 10*b* in the state of the print image shown in FIG. 9.

When original video data (first data) is rewritten into different video data (second data) in step 801, the operation of step 804 is performed according to controls of the CPU 44 and the print controller 71. In step 804, the correction fluid is applied onto a print image corresponding to the original video data by driving of the print head 55 based on the address information recorded on the optical recording surface 10*a*. In this case, the correction fluid is applied while the disk 10 is being rotated as in the print processing.

Figure 11A:
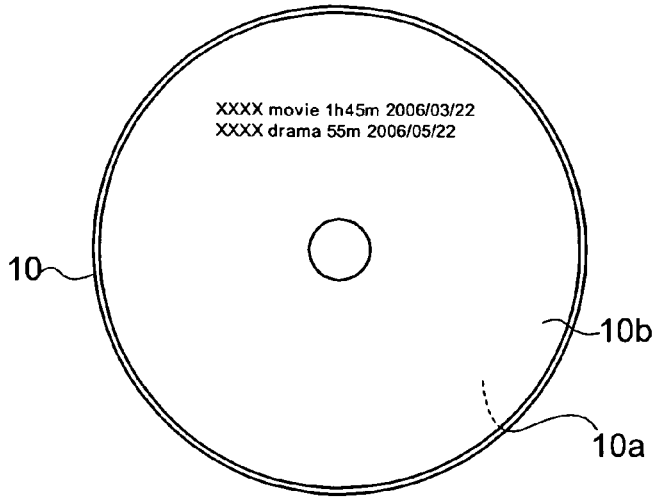
FIGS. 11A to 11C are views showing states of a print target surface of the disk described in steps 804 and 705 when rewriting into different video data is performed.
Figure 11B:
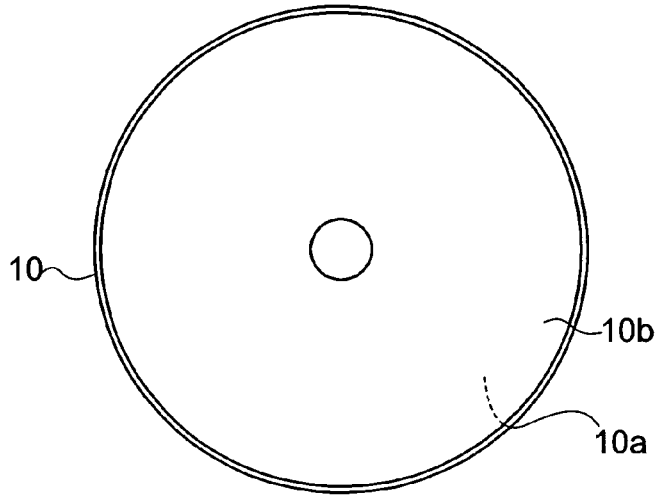
Figure 11C:
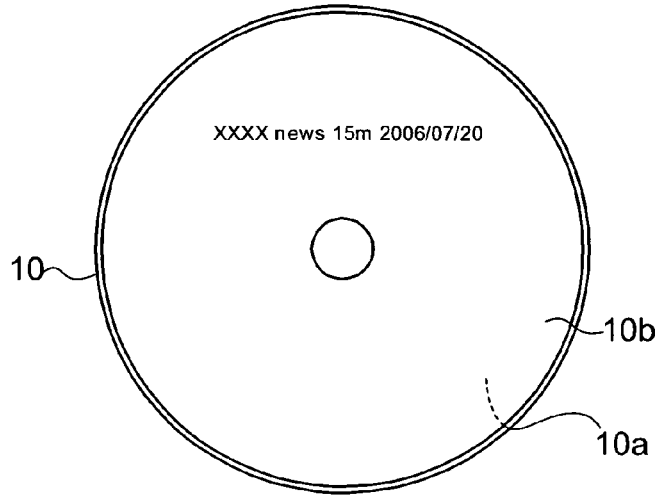

When the application of the correction fluid is completed, a different print image is printed on a region on which the print image is not yet printed, which includes the region onto which the correction fluid has been applied (step 805). This different print image is a print image corresponding to the print information (rewriting print information) generated and stored in step 802. FIGS. 11A to 11C are views showing states of the print target surface 10*b* of the disk 10 described in step 805 when the original video data is rewritten into the different video data. The print image corresponding to the original video data shown in FIG. 11A is erased with the correction fluid as shown in FIG. 11B. Then, as shown in FIG. 11C, the print image corresponding to the different video data is printed.

Figure 12A:
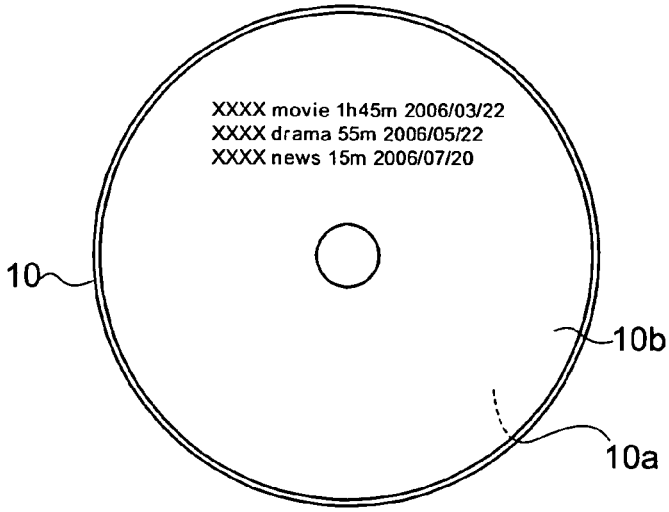
FIGS. 12A to 12C are views sequentially showing print processing when part of data recorded on an optical recording surface is rewritten.
Figure 12B:
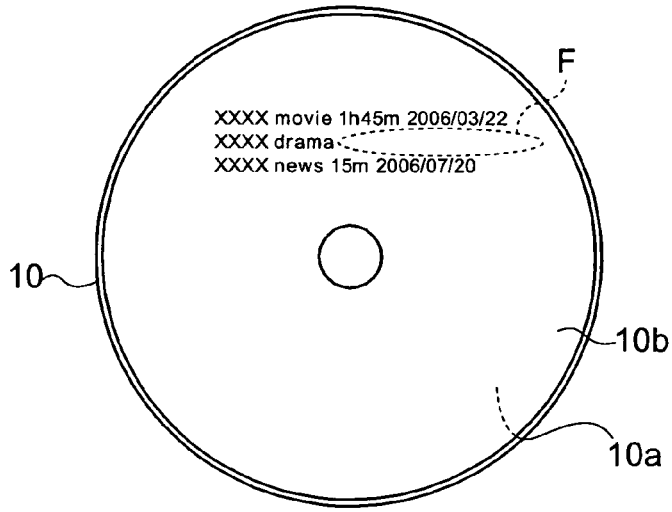
Figure 12C:
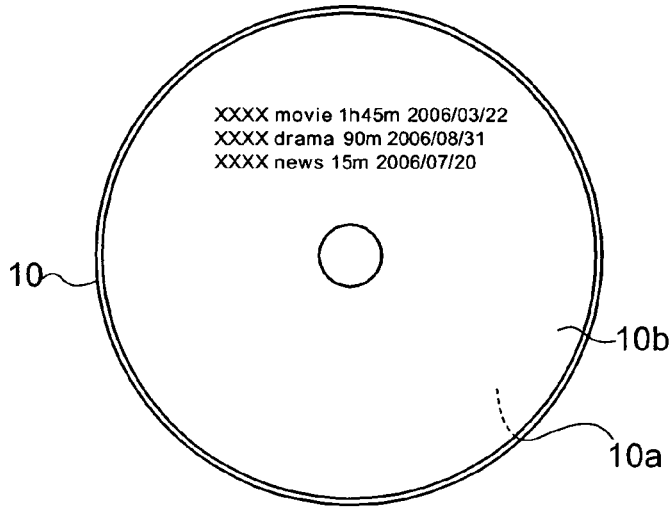

FIGS. 12A to 12C are views sequentially showing print processing when part of data recorded on the optical recording surface 10*a* is rewritten. The disk 10 on which three video data are already recorded as shown in FIG. 12A will be described. For example, it is assumed that video data of a certain drama is rewritten into different video data of the certain drama. In this case, according to controls of the CPU 44 and the print controller 71, the correction fluid is applied onto a region F indicated by a broken line as shown in FIG. 12B, and further, as shown in FIG. 12C, its corresponding image "90 m 2006/08/31" is printed.

Figure 13:
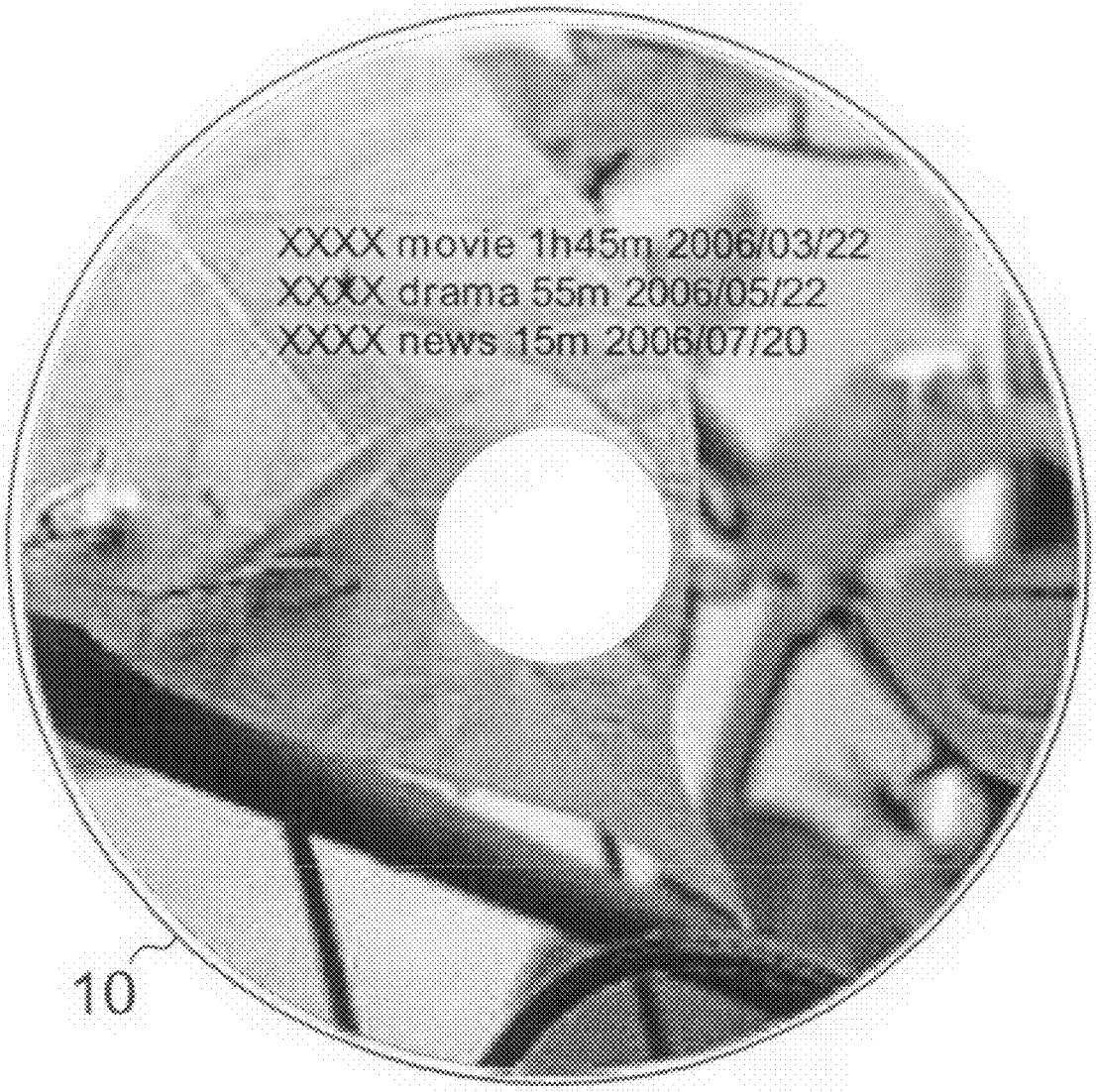
FIG. 13 is a view showing an example of the disk on which a picture is printed as a background of a text image.

FIG. 13 is a view showing an example of the disk on which in addition to printing of text data, a picture is printed as a background of this text image as described above. Even the disk 10 on which a picture is printed as just described can support rewriting of part of data as described next with reference to FIGS. 14A and 14B.

Figure 14A:
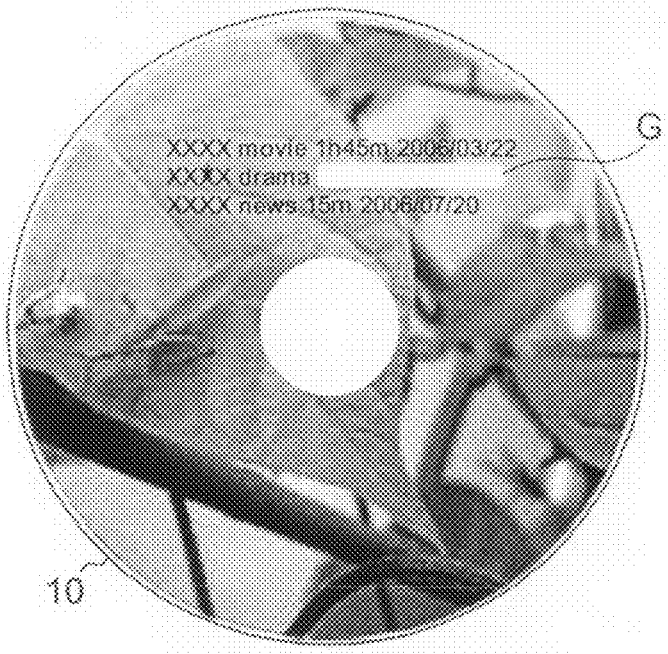
FIGS. 14A and 14B are views sequentially showing print processing when part of data is rewritten in the disk 10 on which the picture is printed.
Figure 14B:
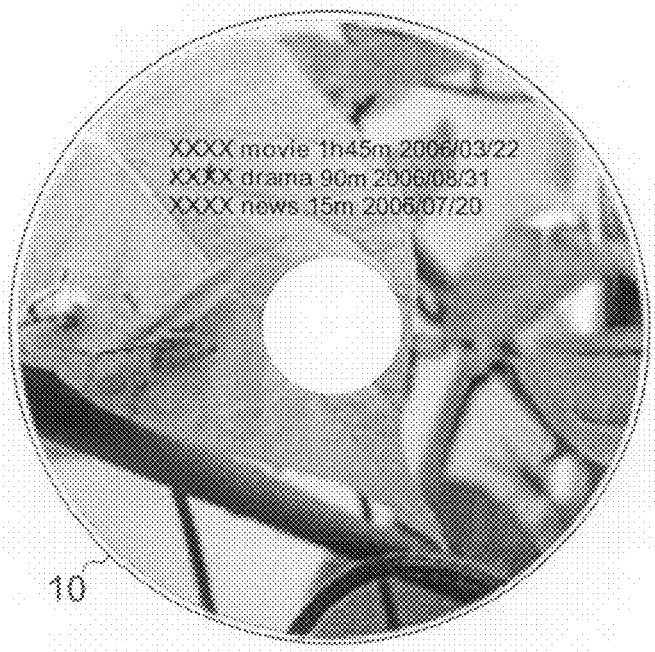

For example, when the disk 10 printed as shown in FIG. 13 is prepared and part of data is rewritten, as shown in FIG. 14A, the correction fluid is applied onto a region G being part of a print image according to controls of the CPU 44 and the print controller 71. Then, as shown in FIG. 14B, a new image (picture and text data) is printed on the region on which the correction fluid has been applied.

Also when the video data recorded on the disk 10 is erased, the print image corresponding to the erased video data is erased by the application of the correction fluid. In this case, for example, the processing described in FIG. 12A to FIG. 12B or FIG. 13 to FIG. 14A is performed.

Note that in the case of rewriting into different video data or erasing, the print information (print information stored in the memory 45) corresponding to the video data identification information may be rewritten or erased according to control of the CPU 44. As just described, whether or not to leave a log of additional recording, rewriting, or erasing may be selected by the user.

As described above, in this embodiment, it becomes possible to correct the print image by applying the correction fluid onto the print target surface 10*b*. This mostly eliminates decentering of the disk 10 compared to when the print image is corrected by putting a sticker or the like over the print image, thereby preventing recording or reproduction of data from becoming unstable. Accordingly, erasing of, additional recording to, and rewriting of print contents can easily be performed.

In this embodiment, the print information is stored in the memory 45 in correspondence with the video data identification information. Therefore, the print image of the print information corresponding to the additionally recorded data can be prevented from being erroneously printed on an already existing different print image, and management of the disk 10 is therefore facilitated.

Figure 15A:
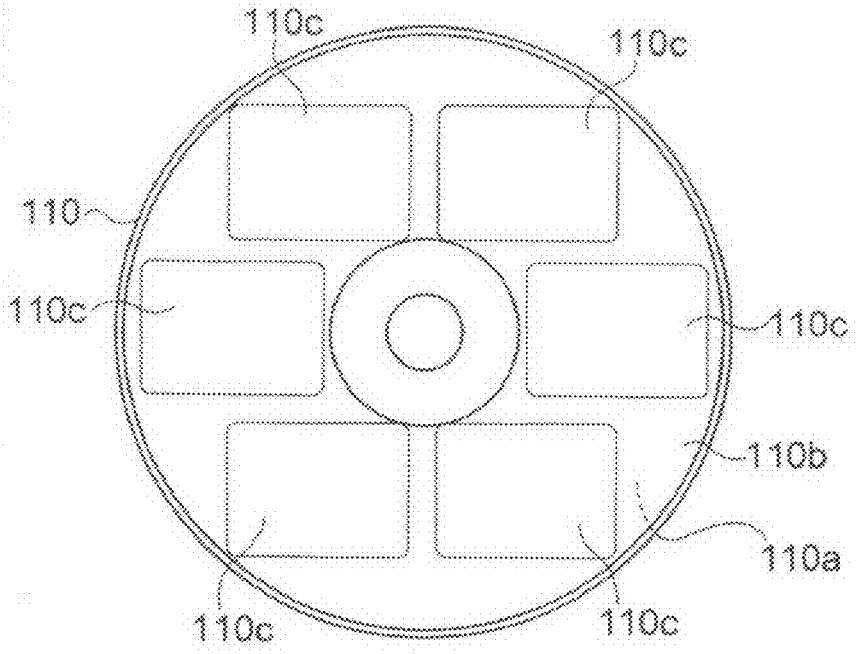
FIG. 15A is a view showing an optical disk as a recording medium according to another embodiment of the present invention.

FIG. 15A is a view showing an optical disk as a recording medium according to another embodiment of the present invention.

This disk 110 previously has plural print target regions 110*c* on a print target surface (second surface) 110*b*. The print target region 110*c* is a region provided on the print target surface 10*b* and can be printed with ink. Accordingly, the print target region 110*c* may be made of any material. Further, a region other than the print target region 110*c* (hereinafter referred to as a non-print target region) and the print target region 110*c* on the print target surface 110*b* may be made of different materials or the same material.

The disk having the print target region 110*c* is a disk which is previously printed so that the print target region 110*c* is surrounded by the print (see FIG. 15A, FIG. 16) or a disk on which the non-print target region is previously printed so that the print target region 110*c* is left. "Previously printed" means "printed in a manufacturing process of the disk". "So that the print target region 110*c* is surrounded" means that any form is possible as long as the user can visually recognize the print target region 110*c*, for example, a form in which part of a surrounding image is broken or intermittently broken as well as the form in which the entire periphery of the print target region 110*c* is surrounded.

The image surrounding the print target region 110*c* is not limited to a square frame shape such as that shown in FIG. 15A and may have any other shape such as a polygonal shape, a circular shape, an oval shape, or any other curved shape. In the disk shown in FIG. 16, a frame is constituted by a picture. In the disk shown in FIG. 17, a picture or the like is printed on the non-print target region, and nothing is printed on the print target regions 110*c*. The number of print target regions may be one, and it is not limited. The size and arrangement of the print target regions 110*c* are not limited either.

Physical position information of the print target region 110*c* on the print target surface 110*b* is recorded on an optical recording surface (first surface) 110*a* (surface on the opposite side of the print target surface 110*b*) of the disk 110. For example, the position information of this print target region 110*c* is information using address information. Accordingly, by reading the address information by the optical pickup 80, the CPU 44 can recognize the position information of the print target region. Further, disk identification information indicating that this disk is a disk having the print target region 110*c* is recorded on the optical recording surface 110*a* of this disk 110. Namely, the optical disk drive apparatus 100 can distinguish this disk from generally-used disks by this disk identification information.

When the position information of the print target region 110*c* is not recorded on the optical recording surface 110*a* of the disk 110, this position information may previously be stored in the ROM 46 or the memory 45 of the optical disk drive apparatus 100. In this case, the ROM 46 or the memory 45 functions as a position information storing means for the print target region 110*c*. In this case, the ROM 46 or the memory 45 has only to store individual disk identification information on each of plural kinds of disks 110 having different numbers, arrangements, sizes, pictures, and so on of the print target region(s) 110*c*. In this case, the disk identification information and the position information of the print target region 110*c* are stored in association with each other. Consequently, the optical disk drive apparatus 100 can support the plural kinds of disks 110 having different numbers, arrangements, sizes, pictures, and so on of the print target region(s) 110*c*.

As described above, by previously providing the print target region 110*c* to the disk 110, the user can reduce troublesome work regarding printing such as making a decision on print layout.

Figure 16:
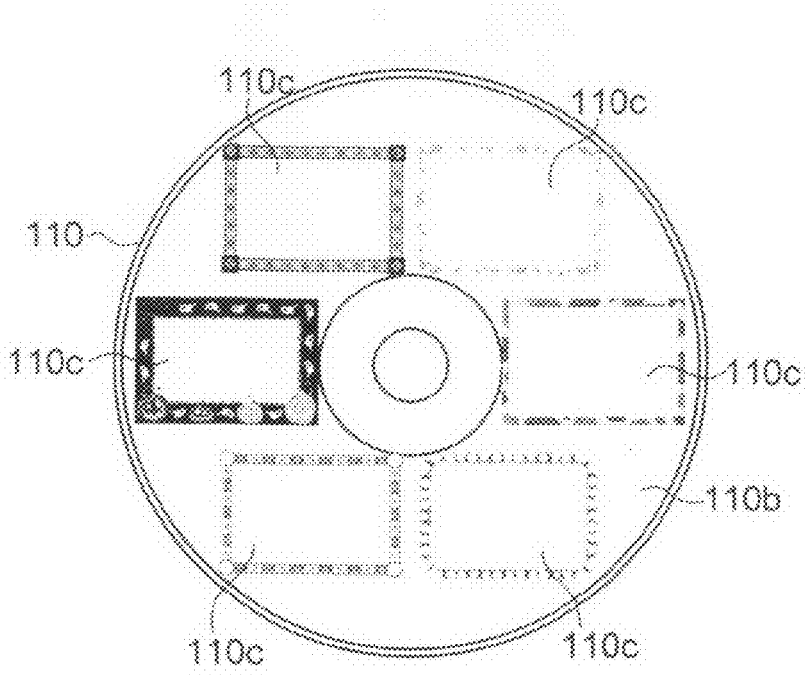
FIG. 16 is a view showing the disk on which frames are constituted by pictures.
Figure 17:
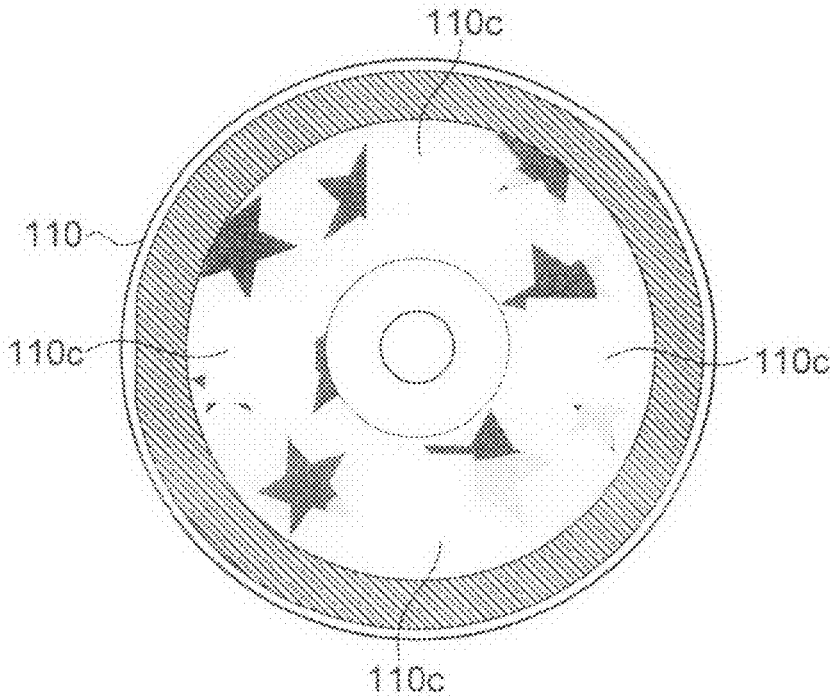
FIG. 17 is a view showing the disk on which a picture or the like is printed on a non-print target surface and nothing is printed on the print target regions.

Moreover, in the disk 110 shown in each of FIG. 16 and FIG. 17, for example, the picture or the like is previously printed, so the amount of ink can be reduced compared to when printing is performed on the entire print target surface 110*b* by the optical disk drive apparatus 100. As a result, print time is significantly shortened. Further, even when the ink prepared by the user is monochrome, the user can finish a color-printed disk.

Figure 18:
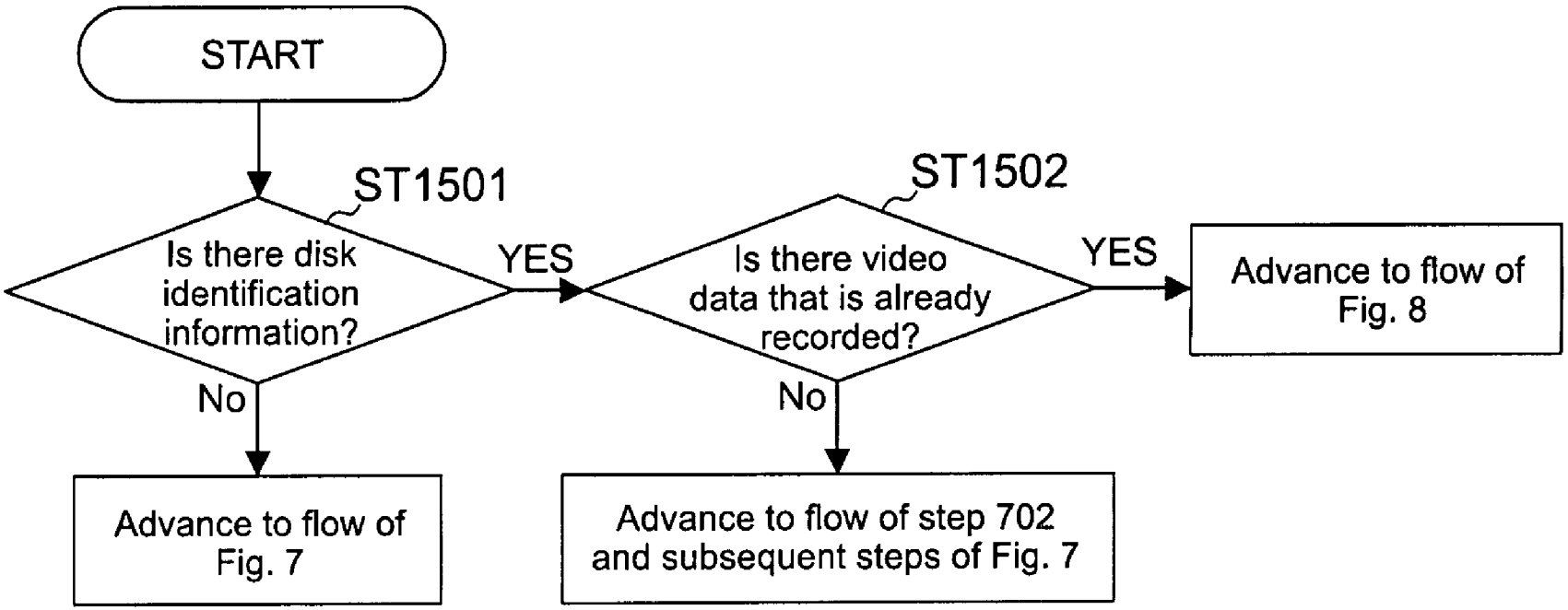
FIG. 18 is a flowchart showing the operation when printing is performed on the disk shown in each of FIG. 16 and FIG. 17.

FIG. 18 is a flowchart showing the operation when printing is performed on the disk 110 shown in each of FIG. 16 and FIG. 17.

When the disk is loaded into the optical disk drive apparatus 100, it is determined whether disk identification information exists by driving of the optical pickup 80 according to control of the recording/reproducing controller 15 (step 1501). In this step 1501, it may be determined whether or not, instead of the disk identification information, information indicating the print target region 110*c* (position information, information on the picture or the like of the print target region 110*c*, hereinafter referred to as print target region information) itself exists.

When the disk identification information or the print target region information does not exist, the process advances to the flow shown in FIG. 7. When the disk identification information or the print target region information exists, it is determined whether or not video data is already recorded on the optical recording surface 110*a* of the disk 110 by driving of the optical pickup 80 according to control of the recording/reproducing controller 15 (step 1502).

Figure 15B:
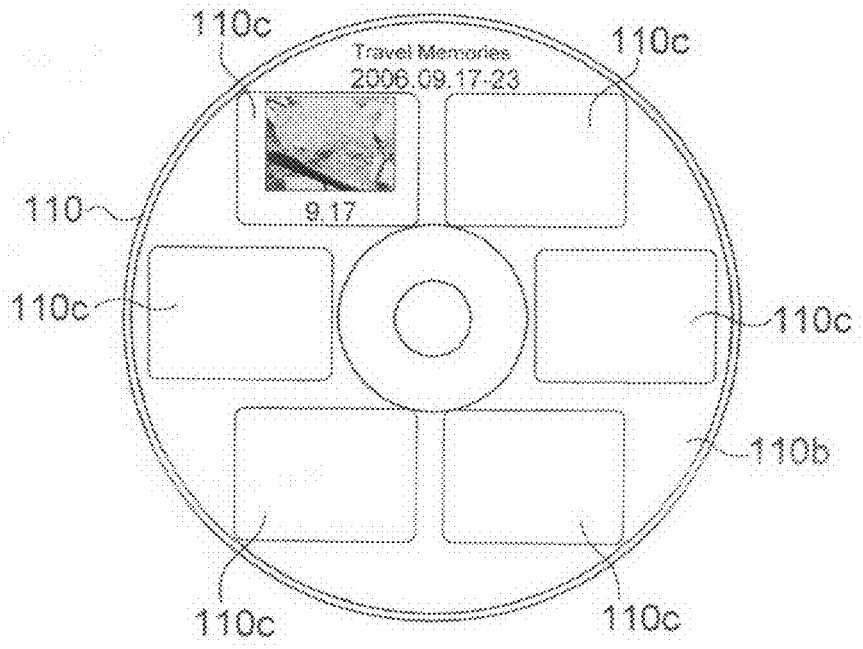
FIG. 15B shows the disk on which, for example, when one video data is recorded from the state shown in FIG. 15A, a print image corresponding to the video data is printed on a print target region.

When the video data is not recorded on the disk 110, the process advances to step 702 and the subsequent steps of FIG. 7. When the video data is recorded on the disk 110, the process advances to the flow shown in FIG. 8. In this case, in step 802 and the subsequent steps, a print image is generated on the print target region 110*c*. FIG. 15B shows the disk on which, for example, when one video data is recorded from the state shown in FIG. 15A, a print image corresponding to the video data is printed on the print target region.

For example, when the above frame or the like is printed on the print target surface 110*b* in the manufacturing process of such a disk 110, the printing can be performed while address information is read by the optical pickup 80. In this case, it is only necessary that the frame or the like is printed with certain address information as an origin. By initially setting the address information of the above origin by the optical disk drive apparatus 100, the user can perform printing accurately on the print target region by the optical disk drive apparatus 100.

Figure 19A:
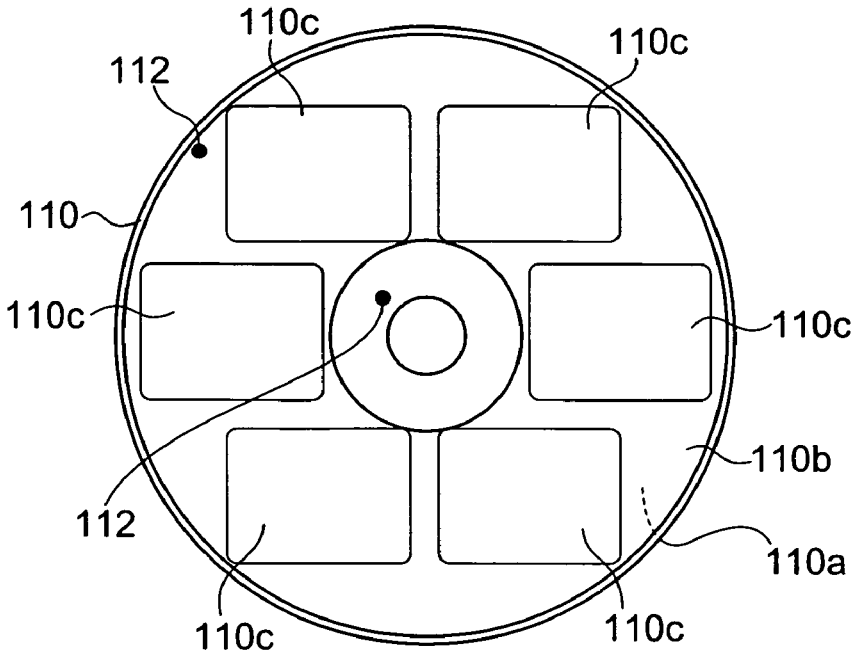
FIGS. 19A and 19B are views each showing the disk provided with a mark.

Alternatively, in the process of manufacturing the disk shown in each of FIG. 15A to FIG. 17, a mark indicating the position of the origin when the frame or the like is printed may be provided. In other words, this mark becomes a mark for the optical disk drive apparatus 100 to detect the print target region. An example of the mark is a dot mark 112 printed on the print target surface as shown in FIG. 19A. The mark 112 may be provided at any position on an inner or outer side of the disk 110.

If the light reflectance of the dot mark 112 is made different from the light reflectance of a region other than this dot mark 112 on the print target surface 110*b*, this mark 112 can be detected, for example, using a reflective optical sensor not shown. In this case, the optical disk drive apparatus 100 only needs to include this optical sensor on the side facing the print target surface 10*b*. As just described, it becomes possible to detect the mark 112 by the inexpensive constitution of the optical sensor or the like.

If such a mark 112 is provided, the optical disk drive apparatus 100 can accurately perform printing on the print target region based on the address information recorded on the optical recording surface 110*a* and output information of the optical sensor. For example, using the address information and the output information of the optical sensor, the recording/reproducing controller 15 or the CPU 44 shown in FIG. 6 functions as a detecting means for detecting the print target region 110*c*.

The color of the mark 112 may be any color, for example, a color like black which reduces the reflectance, a color which increases the reflectance as a mirror, or the like is conceivable. Alternatively, a color that passes light of the optical sensor (transparent, for example) is also possible. When the light transmits through the mark as just described, either the reflective or transmissive optical sensor may be used.

Figure 19B:
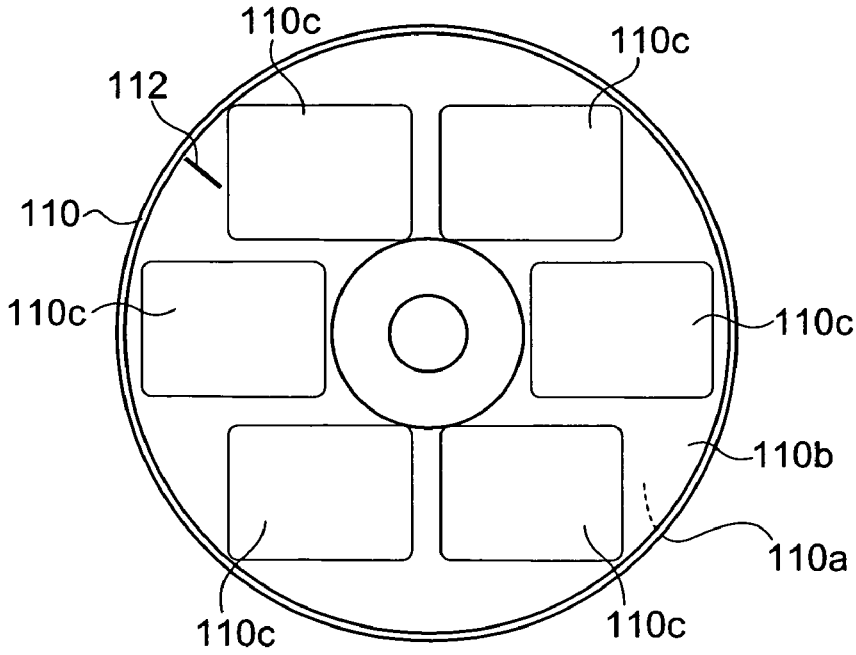

The mark 112 may also be a line as shown in FIG. 19B or any other shape without being limited to the dot shape.

Alternatively, such a mark 112 may be optically recorded on the optical recording surface 110*a*. In this case, the above optical sensor becomes unnecessary, and the mark 112 can be detected by the optical pickup 80, resulting in a reduction in cost.

Figure 20:
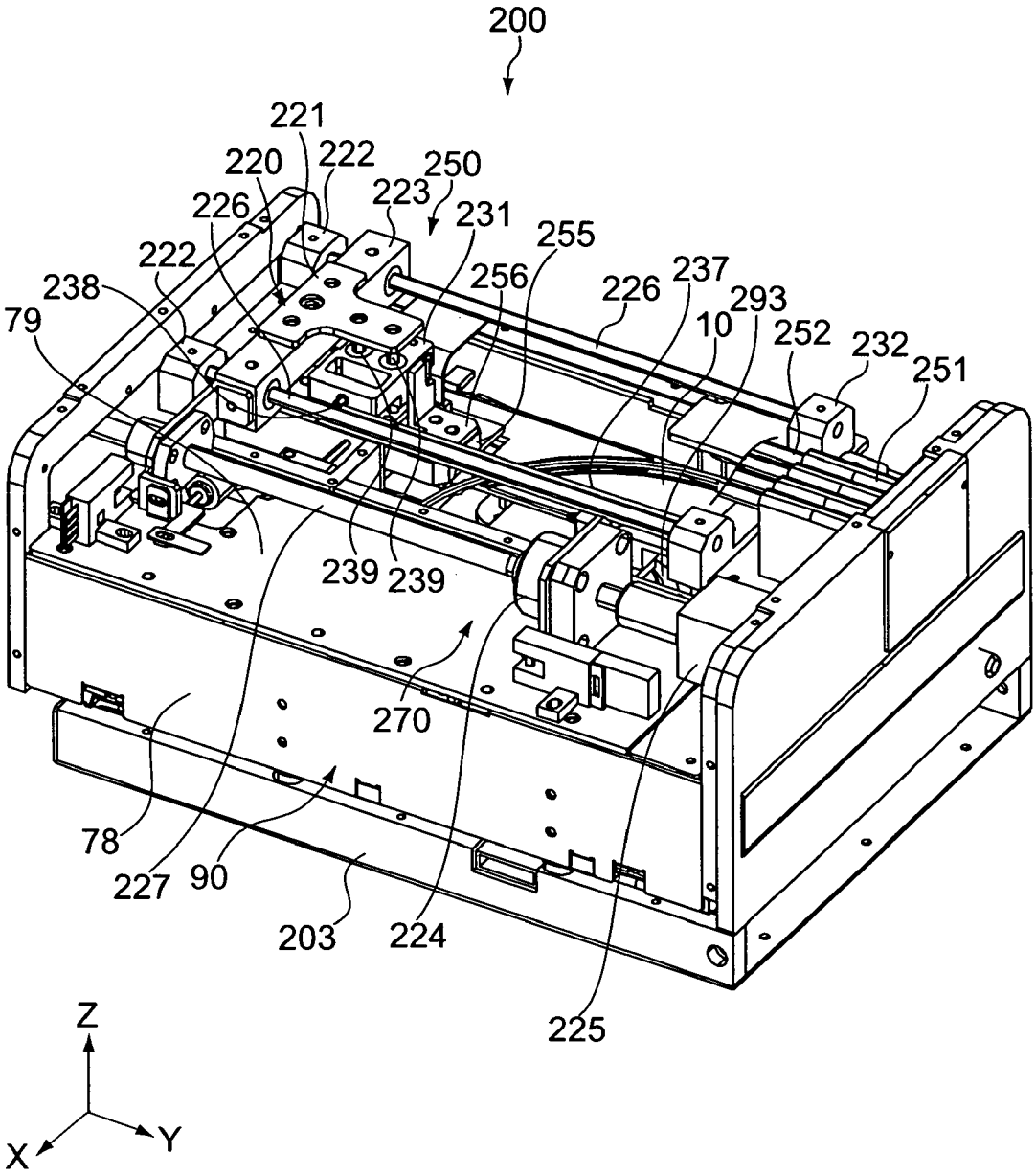
FIG. 20 is a perspective view showing the internal structure of an optical disk drive apparatus according to another embodiment.
Figure 21:
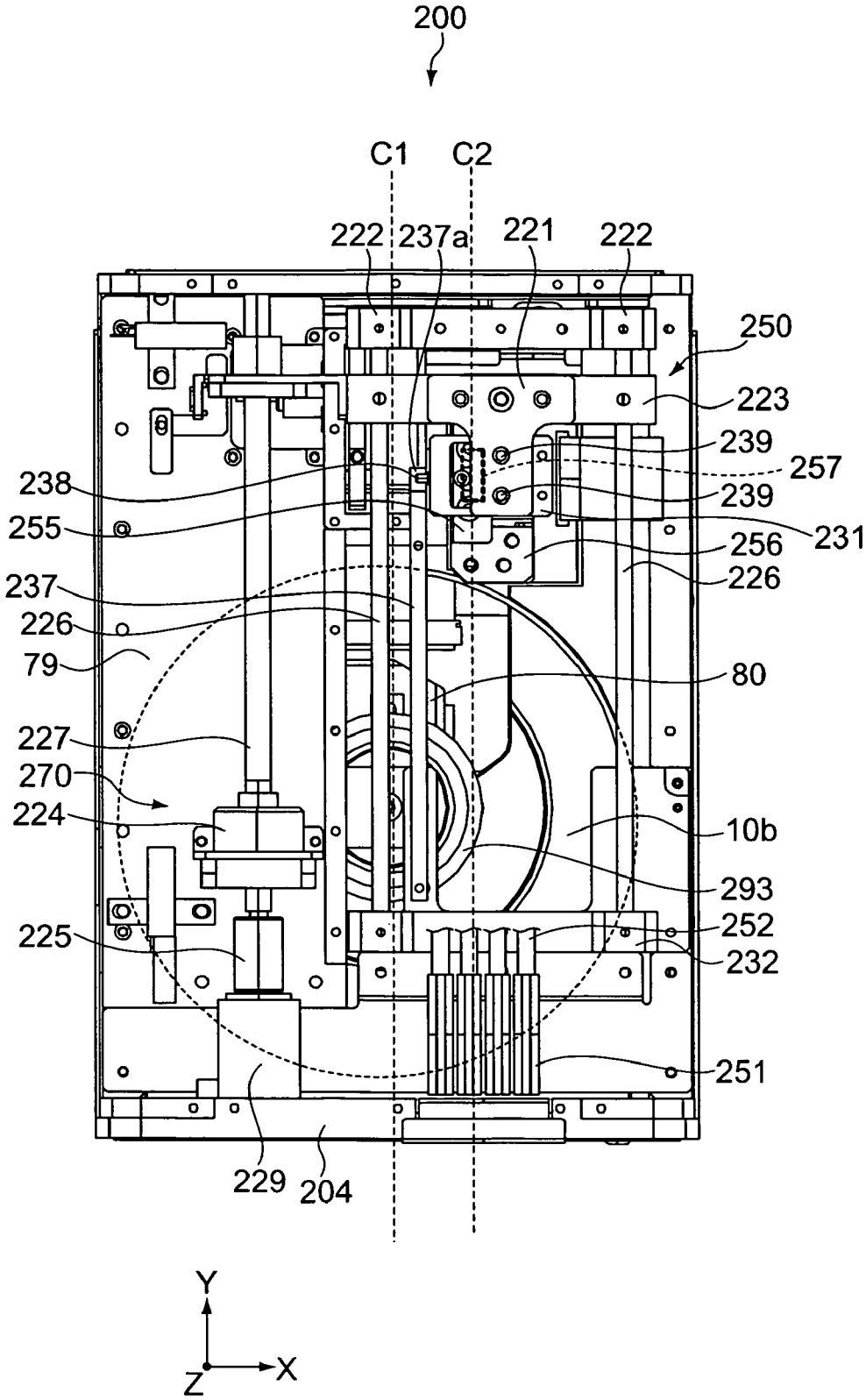
FIG. 21 is a plan view of the optical disk drive apparatus shown in FIG. 20.

FIG. 20 is a perspective view showing the internal structure of an optical disk drive apparatus according to another embodiment. FIG. 21 is a plan view of an optical disk drive apparatus 200 shown in FIG. 20. In the following description, the description of the same members, functions, and so on as those of the optical disk drive apparatus 100 according to the embodiment shown in FIG. 1 and so on will be simplified or omitted, and different points will mainly be described.

As shown in FIG. 21, a printing unit 250 of the optical disk drive apparatus 200 includes a print head 255 provided so as to be movable on a straight line C2 not passing a center of the disk 10 held by a chucking plate 293. A straight line passing the center of the disk 10 is represented by reference symbol C1.

A moving mechanism 220 which moves the print head 255 includes a holder 256 which holds the print head 255, a vertically moving block 231 which is connected to the holder 256, a coupling plate 221 which is connected to vertical guide shafts 239 inserted through the vertically moving block 231, and a horizontally moving block 223 which is connected to the coupling plate 221. Further, the moving mechanism 220 includes a drive portion 270 which drives the horizontally moving block 223. The drive portion 270 includes a drive motor 229 and a ball screw 227 which is connected to the drive motor 229 via a coupling 225 and connected to the horizontally moving block 223. A support holder 224 is provided therein with a bearing and holds the ball screw 227.

Figure 22:
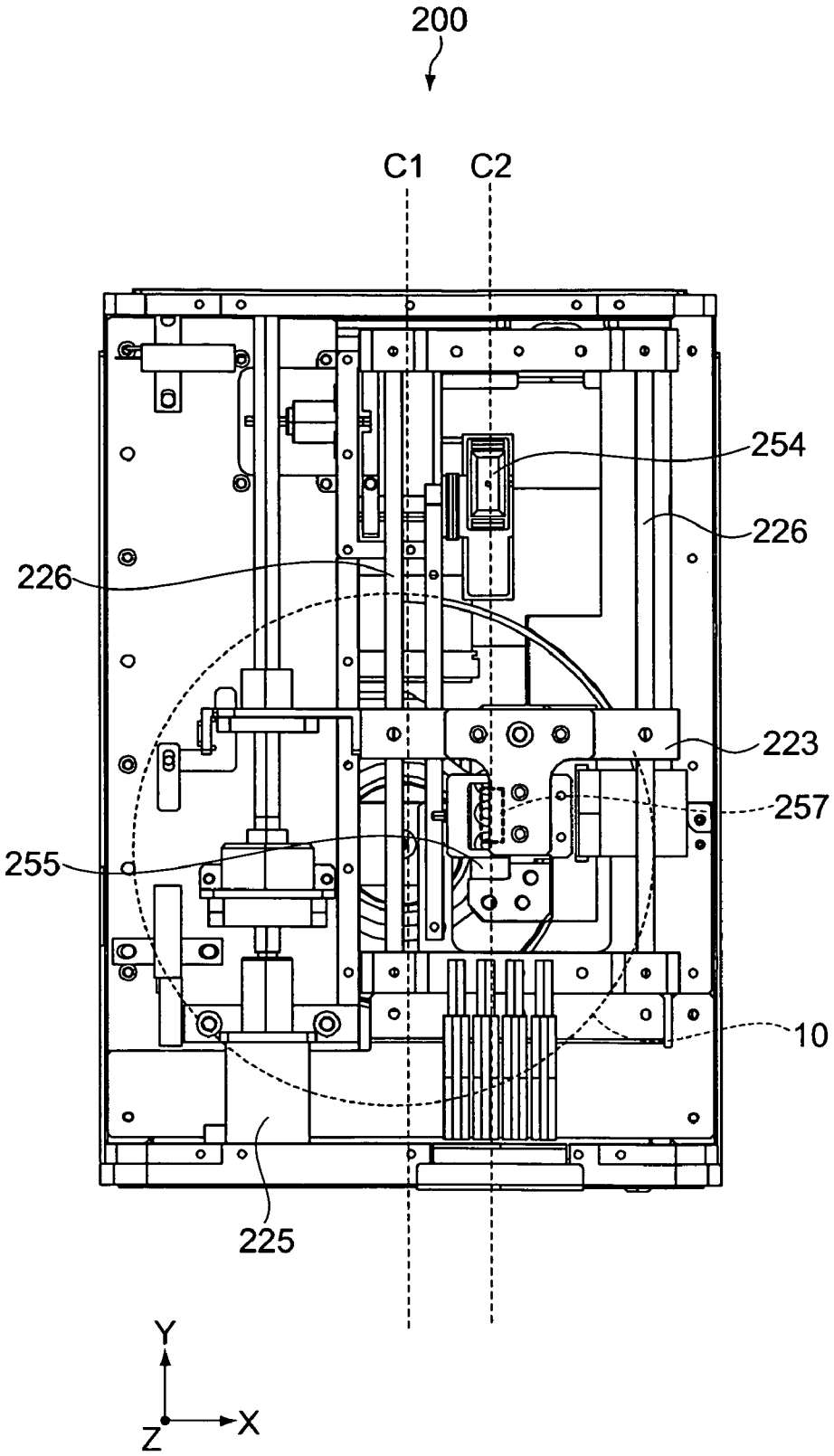
FIG. 22 is a plan view showing a state where a print head is moved to the front side by a moving mechanism.

A guide pin 238 is provided on a side surface of the vertically moving block 231, and the guide pin 238 moves on a guide rail 237 shown in FIG. 21. A slope 237*a* is formed on the back side of the guide rail 237, and the guide pin 238 travels on the slope 237*a* by the movement of the horizontally moving block 223 in a horizontal direction (Y direction), whereby the vertically moving block 231 moves up and down. FIG. 22 is a plan view showing a state where the print head 255 is moved to the front side by the moving mechanism 220. A cap 254 is placed at a standby position of the print head 255 (on the back side). Namely, as a result of the movement of the print head 255 to the back side and downward movement of the vertically moving block 231, an ink discharge portion 257 of the print head 255 is covered with the cap 254.

Incidentally, part of the drive unit 90 which records data on or reproduces data from the optical recording surface 10*a* of the disk 10 is covered with an upper cover 79 and a side cover 78.

Figure 23:
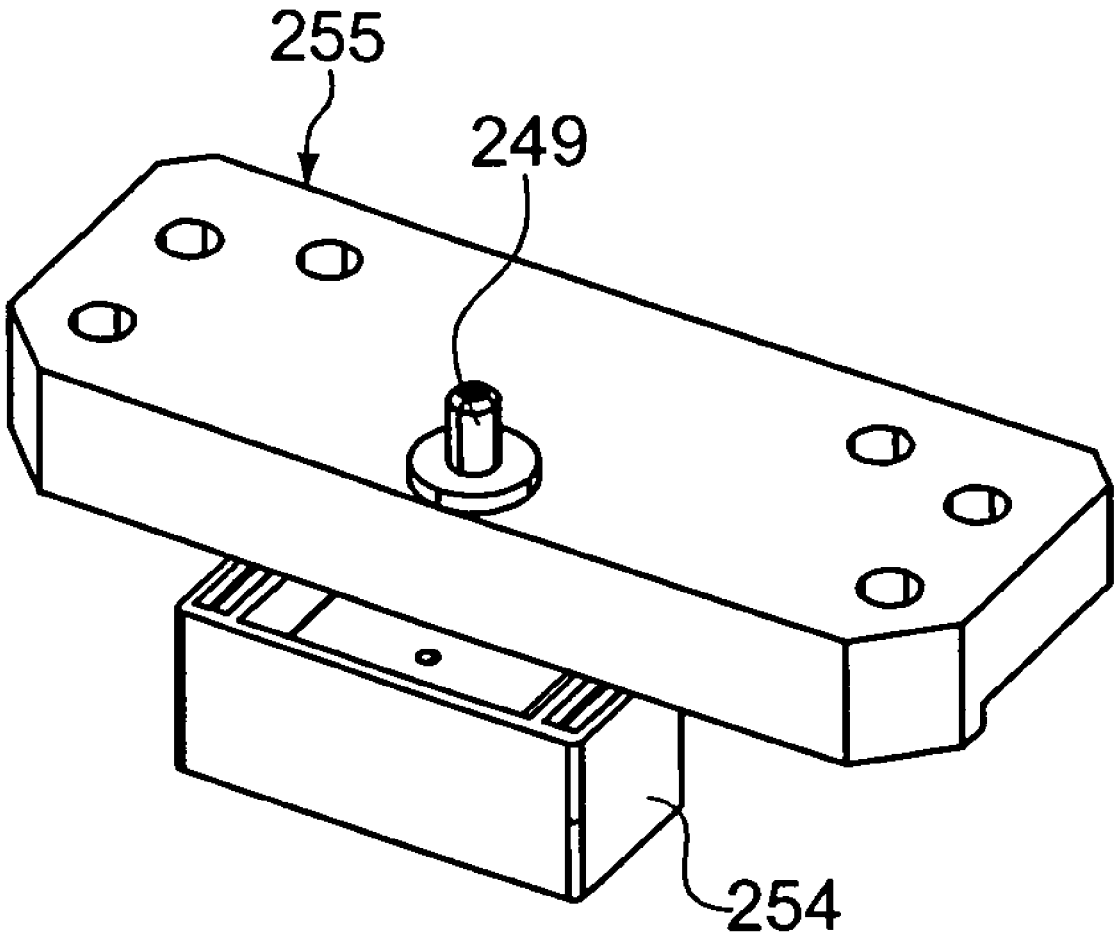
FIG. 23 is a perspective view showing an example of a print head and a cap.
Figure 24:
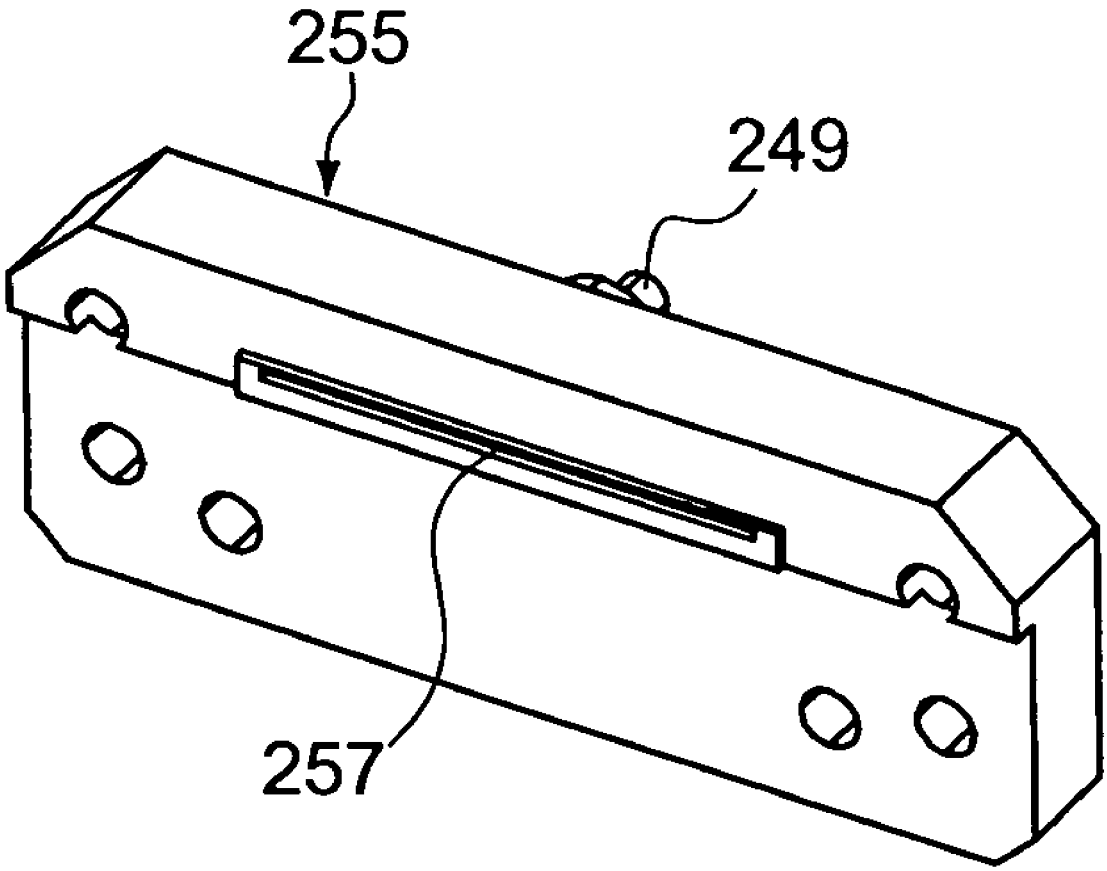
FIG. 24 is a perspective view of the print head viewed from the lower side.

FIG. 23 is a perspective view showing an example of the print head 255 and the cap 254. FIG. 24 is a perspective view of the print head 255 viewed from the lower side. As shown in FIG. 23, a tubular ink supply portion 249 is provided at the top of the print head 255. As shown in FIG. 24, the ink discharge portion 257 is provided at the bottom of the print head 255. The print head 255 shown in FIG. 23 and FIG. 24 is a print head for monochrome use, that is, only for black ink, but typically, the print head 255 for color use is provided. In the case of the print head 255 for color use, plural ink supply portions 249 and plural ink discharge portions 257 corresponding to the number of colors are provided.

As shown in FIG. 20 and FIG. 21, plural printing ink tanks 251 corresponding to respective colors are placed on the front side of the printing unit 250. Ends of ink supply tubes 252 are respectively connected to the ink tanks 251, and the other ends thereof are connected to the ink supply portions 249 of the print head 255. In this case, there are plural supply tubes 252, and hence the print head 255 is a print head for color use provided with plural ink supply portions 249 and plural ink discharge portions 257. The supply tube 252 has flexibility. This flexibility is realized, for example, by the supply tube 252 itself being formed of a flexible resin. Alternatively, a supply tube having a bellows may be used.

As shown in FIG. 21 and FIG. 22, the print head 255 is moved by the above moving mechanism 220 so that the ink discharge portion 257 moves on the straight line C2 not passing the center of the disk 10.

Also in this optical disk drive apparatus 200, the operations shown in FIG. 7, FIG. 8, and FIG. 18 can be performed.

According to this optical disk drive apparatus 200, printing can be performed while the print head 255 is at a standstill or being moved in the Y direction when the disk 10 is rotating at a predetermined rpm.

Alternatively, printing can be performed while the disk 10 is at a standstill without rotating and the print head is at a standstill or being moved in the Y direction.

Alternatively, because the disk 10 moves in the Y direction when transferred by the disk tray 7, printing can be performed while the print head 255 is at a standstill or being moved in the Y direction. Typically, printing is performed when the disk 10 is ejected by the disk tray 7. However, it may be performed when the disk 10 is loaded. By performing printing by utilizing the transfer of the disk 10, the print speed increases. This print method becomes particularly effective when characters or the like are printed at a position off the center of the disk 10 as shown in FIG. 9.

Embodiments according to the present invention are not limited to the embodiments described above, and various other embodiments are conceivable.

In a case where printing is performed regardless of the physical address information of the optical recording surface when the frame or the like (see FIG. 16, for example) is printed on the print target surface, the following coping process may be adopted. For example, in the case of the same lot, the physical address information of the optical recording surface and the positional relation of the print data correspond to each other. Hence, one disk is extracted from the lot, and a mark indicating a start position is printed at an appropriate position on the disk while the physical address information is read by the above optical disk drive apparatus 100. This mark of the start position may be any mark. Then, an original point of the print position and the angle (rotation angle from the mark of the start position) of the frame or the like are calibrated. The address information and a calibration value used when the frame or the like is printed are both recorded on the optical recording surface 10*a* of the disk 10. When performing additional printing on the print target surface 10*b*, the optical disk drive apparatus 100 can recognize the position of the additional printing by reading the address information and the calibration value and performing a print position correction.

Various shapes, structures, and so on of the respective portions of the drive unit 90 and the printing units 50 and 250 are conceivable. The memory 45 may be a hard disk or any other storing means instead of the semiconductor memory or the like.

In the above descriptions of the operations shown in FIG. 7, FIG. 8, and FIG. 18, the example in which the print information or the like and its corresponding video data identification information are stored in the memory 45 included in the optical disk drive apparatus 100 is shown. However, the print information or the like and its corresponding video data identification information may be controlled to be optically recorded on the optical recording surface 10*a* of the disk 10 (recording control means).

In the flows shown in FIG. 7, FIG. 8, and FIG. 18, the video data may be reproduced after each step depending on the user's intention or the like. Alternatively, the operation may be terminated or the disk 10 may be ejected from the optical disk drive apparatus 100 after each step depending on the user's intention or the like. Alternatively, a form in which the print processing of each of steps 707 and 805 is not performed based on the user's intention or the like is also conceivable.

Figure 25:
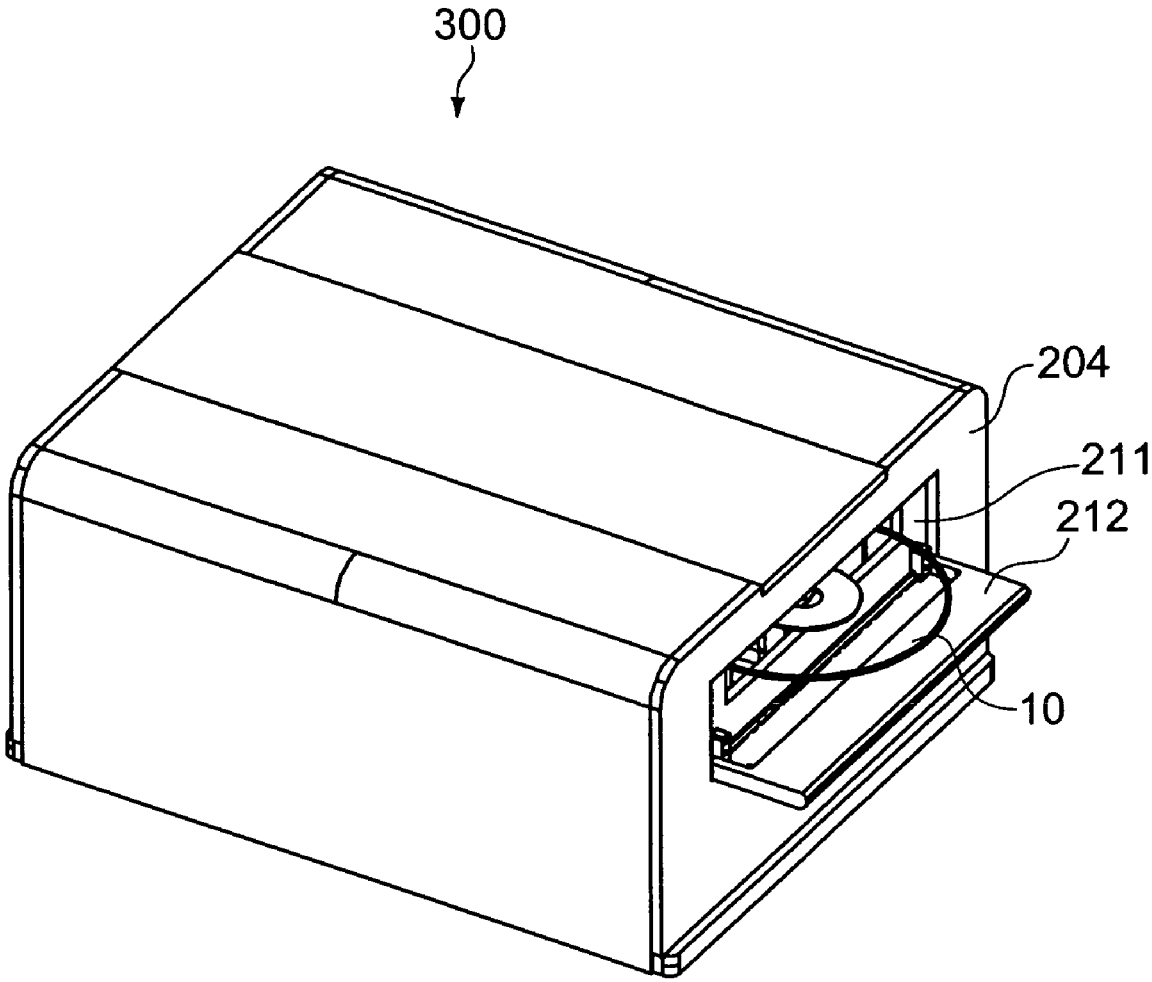
FIG. 25 is a perspective view showing a slot-in type optical disk drive apparatus.

In the above embodiments, the disk-tray type optical disk drive apparatus 100 as shown in FIG. 1 is described. However, a slot-in type optical disk drive apparatus 300 as shown in FIG. 25 may also be used. In this apparatus, an opening 211 is provided in a front panel 204, and the disk 10 is inserted and ejected while a slot cover 212 is opened.

It should be understood by those skilled in the art that various modifications, combinations, sub-combinations and alterations may occur depending on design requirements and other factors insofar as they are within the scope of the appended claims or the equivalents thereof.

What is claimed is:

1. A recording medium drive apparatus, comprising:

a holding mechanism holding a recording medium having a print target surface targeted for printing and an optical recording surface for data;

a data recording means for recording the data on the optical recording surface of the recording medium held by the holding mechanism; and a printing means for performing printing on the print target surface of the recording medium and applying a correction fluid on the print target surface, a storing means for storing print information, the print information being information on a print image to be printed on the print target surface, and data identification information identifying the data, in association with each other, wherein when first data, the first data being data recorded on the recording medium before rewriting by the data recording means, recorded on the recording medium, is rewritten by the data recording means into second data, the storing means stores second data identification information that identifies the second data, and rewriting print information that corresponds to the second data out of the print information, in association with each other, and wherein the printing means applies the correction fluid on a first print image corresponding to the first data and prints a second print image corresponding to the stored rewriting print information on the print target surface.

2. The recording medium drive apparatus as set forth in claim 1, wherein when additional data is additionally recorded on the recording medium by the data recording means, the storing means stores additional data identification information that identifies the additional data, and additional print information that corresponds to the additional data out of the print information, in association with each other, and wherein the printing means prints a print image corresponding to the stored additional print information on the print target surface.

3. The recording medium drive apparatus as set forth in claim 1, further comprising a recording control means for controlling the data recording means so that print information, the print information being information on a print image to be printed on the print target surface, and identification information identifying the data, are recorded on the optical recording surface in association with each other.

4. The recording medium drive apparatus as set forth in claim 3, wherein when additional data is additionally recorded on the recording medium by the data recording means, the recording control means records additional data identification information identifying the additional data, and additional print information corresponding to the additional data out of the print information, in association with each other, and wherein the printing means prints a print image corresponding to the recorded additional print information on the print target surface.

5. The recording medium drive apparatus as set forth in claim 1, wherein the recording medium has a print target region which is provided on the print target surface and targeted for the printing, the recording medium drive apparatus further comprising a position information storing means for storing position information indicating a position of the print target region on the print target surface.

6. The recording medium drive apparatus as set forth in claim 5, wherein the recording medium has a mark provided on the print target surface, the recording medium drive apparatus further comprising:

a sensor detecting the mark; and a detecting means for detecting the print target region using the mark detected by the sensor and address information indicating a position on the optical recording surface recorded on the optical recording surface.

7. The recording medium drive apparatus as set forth in claim 5, wherein the recording medium has a mark provided on the optical recording surface, the recording medium drive apparatus further comprising:

a data reproducing means for detecting the mark; and a detecting means for detecting the print target region using the mark detected by the data reproducing means and address information indicating a position on the optical recording surface recorded on the optical recording surface.

8. A recording medium drive apparatus, comprising:

a holding mechanism holding a recording medium having a print target surface targeted for printing and an optical recording surface for data;

a data recording means for recording the data on the optical recording surface of the recording medium held by the holding mechanism; and a printing means for performing printing on the print target surface of the recording medium and applying a correction fluid on the print target surface, a storing means for storing print information, the print information being information on a print image to be printed on the print target surface, and data identification information identifying the data, in association with each other, wherein when erasing target data recorded on the recording medium is erased by the data recording means, the storing means erases erasing target print information corresponding to the erasing target data out of the print information, and wherein the printing means applies the correction fluid on an erasing target print image corresponding to the erasing target print information.

9. A recording medium drive apparatus, comprising:

a holding mechanism holding a recording medium having a print target surface targeted for printing and an optical recording surface for data;

a data recording means for recording the data on the optical recording surface of the recording medium held by the holding mechanism; and a printing means for performing printing on the print target surface of the recording medium and applying a correction fluid on the print target surface, a recording control means for controlling the data recording means so that print information, the print information being information on a print image to be printed on the print target surface, and identification information identifying the data, are recorded on the optical recording surface in association with each other, wherein when first data the first data being data recorded on the recording medium, before rewriting by the data recording means is rewritten by the data recording means into second data, the recording control means records second data identification information that identifies the second data, and rewriting print information that corresponds to the second data out of the print information, in association with each other, and wherein the printing means applies the correction fluid on a first print image corresponding to the first data and prints a second print image corresponding to the recorded rewriting print information on the print target surface.

10. A recording medium drive apparatus, comprising:

a holding mechanism holding a recording medium having a print target surface targeted for printing and an optical recording surface for data;

a data recording means for recording the data on the optical recording surface of the recording medium held by the holding mechanism; and a printing means for performing printing on the print target surface of the recording medium and applying a correction fluid on the print target surface, a recording control means for controlling the data recording means so that print information, the print information being information on a print image to be printed on the print target surface, and identification information identifying the data, are recorded on the optical recording surface in association with each other, wherein when erasing target data recorded on the recording medium out of the data is erased by the data recording means, the recording control means erases erasing target print information corresponding to the erasing target data out of the print information, and wherein the printing means applies the correction fluid on an erasing target print image corresponding to the erasing target print information.

* * * * *